US005977941A

United States Patent [19]

Katoh et al.

[11] Patent Number: 5,977,941

[45] Date of Patent: Nov. 2, 1999

[54] SCANNING CIRCUIT AND MATRIX-TYPE IMAGE DISPLAY DEVICE

[75] Inventors: Ken-ichi Katoh, Higashihiroshima; Yasushi Kubota, Sakurai, both of Japan

[73] Assignee: Sharp Kabushiki Kaisha, Osaka, Japan

[21] Appl. No.: 08/841,811

[22] Filed: May 5, 1997

[30] Foreign Application Priority Data

May 30, 1996 [JP] Japan ..... 8-137274

[51] Int. Cl.[6] ..... G09G 3/36

[52] U.S. Cl. ..... 345/94; 345/98

[58] Field of Search ..... 345/94, 99, 98, 345/103, 95, 87, 100, 208, 210; 359/54, 55

[56] References Cited

U.S. PATENT DOCUMENTS

| | | | |
|---|---|---|---|
| 3,921,166 | 11/1975 | Volpe . | |
| 5,051,739 | 9/1991 | Hayashida et al. . | |
| 5,153,568 | 10/1992 | Shaw . | |
| 5,430,461 | 7/1995 | Tsai | 345/98 |
| 5,719,591 | 2/1998 | Callahan, Jr. et al. | 345/98 |

FOREIGN PATENT DOCUMENTS

| | | |
|---|---|---|
| 5-22917 | 3/1993 | Japan . |
| 5-70157 | 10/1993 | Japan . |
| 7-66252 | 7/1995 | Japan . |
| 7-66256 | 7/1995 | Japan . |

*Primary Examiner*—Regina Liang
*Attorney, Agent, or Firm*—Nixon & Vanderhye P.C.

[57] ABSTRACT

A scanning circuit has L scan control signal lines to which scan control signals differing from each other are supplied, and x pulse generating circuits each of which outputs a pulse signal based on a logical computation on scan control signals supplied from m signal lines, combinations of the m signal lines differing from each other. The scan control signal lines are divided into m groups so that the m groups respectively correspond to m groups of signals supplied to the scan control signal lines. Each of at least m−1 groups among the m groups is composed of three to four scan control signals differing in phases. One scan control signal is selected from each of the m scan control signal line groups so as to constitute each combination of the m scan control signal lines for sending the scan control signals to each pulse generating circuit.

21 Claims, 14 Drawing Sheets

SCANNING CIRCUIT AND MATRIX-TYPE IMAGE DISPLAY DEVICE

CROSS REFERENCE TO RELATED CO-PENDING APPLICATION

This application is related to co-pending U.S. patent application Ser. No. 08/725,314 filed Oct. 2, 1996.

FIELD OF THE INVENTION

The present invention relates to a scanning circuit and a matrix-type image display device incorporating the same. The scanning circuit is applied to, for example, at least either a data signal line driving circuit or a scanning signal line driving circuit in a matrix-type image display device used as a display device of a TV or a computer.

BACKGROUND OF THE INVENTION

As an arrangement of a conventional matrix-type image display device such as a liquid crystal display device, an arrangement shown in FIG. 13 has been well known. In this image display device, a plurality of data signal lines 51 and a plurality of scanning signal lines 52 are provided so as to be orthogonal to each other on one of a pair of substrates or the both. Around each intersection of the signal lines 51 and 52, a pixel (not shown) is provided. The data signal lines 51 are connected to a data signal line driving circuit 53, so that data signals (image signals) to be applied to the pixels are supplied from the data signal line driving circuit 53 to the data signal lines 51. On the other hand, the scanning signal lines 52 are connected to a scanning signal line driving circuit 54, so that scan signals for selecting pixels to receive the data signals supplied to the data signal lines 51 are supplied from the scanning signal line driving circuit 54 to the scanning signal lines 52.

A schematic arrangement of the data signal line driving circuit 53 is shown in FIG. 14. The data signal line driving circuit 53 incorporates a scanning circuit 55 for sequentially outputting pulse signals at fixed intervals, and a sample-and-hold circuit (hereinafter referred to as S/H circuit) 56 for sampling and outputting the data signals inputted thereto from outside in response to signals supplied from the scanning circuit 55. The scanning signal line driving circuit 54 has substantially the same arrangement, wherein usually a buffer circuit is used instead of the S/H circuit 56.

Any of the driving circuits 53 and 54 requires the scanning circuit 55. There are two types of the scanning circuit 55, namely, (1) one type using a shift register, and (2) the other type using a decode circuit, a multiplexer circuit, or the like, for conducting simple logical computations with respect to a plurality of pulse signals supplied thereto so as to output pulse signals.

As an example of the latter type (2), a circuit structure in the case where a decode circuit is used therein is shown in FIG. 15. Note that the figure is simplified for purposes of illustration, with a small number of signal lines or the like being shown.

The scanning circuit 55 has scan control signal lines (hereinafter referred to as SCS lines) 61 composed of signal lines $\mathbf{61}_1$ through $\mathbf{61}_8$, and a pulse generating circuit 62 composed of circuits $\mathbf{62}_1$ through $\mathbf{62}_{16}$. Each pulse generating circuit 62 conducts logical computations with respect to signals supplied from the SCS lines 61 and outputs the computation results. Each pulse generating circuit 62 has m (m=4 in this example) input terminals, and the n'th ($n \leqq m$) input terminal is supplied with a signal from either the signal line $\mathbf{61}_{2n-1}$ or the signal line $\mathbf{61}_{2n}$ of the SCS lines 61. In addition, combinations of scan control signals supplied to the pulse generating circuits 62through $\mathbf{62}_{16}$ differ from one another. By doing so, $2^4$ (=16) pulse signals at most are controlled.

FIG. 16 is a timing chart illustrating examples of signal waveforms applied to respective parts of the scanning circuit 55. The scan control signals SCS61 through $SCS_{68}$ are supplied to the SCS lines $\mathbf{61}_1$ through $\mathbf{61}_8$, respectively. To be more specific, supplied to the signal lines $\mathbf{61}_{2n-1}$ and the signal line $\mathbf{61}_{2n}$ during a scanning period are signals which have a phase difference of 180° from each other and which have cycles and pulse widths $2^n$ times and $2^{n-1}$ times as great as a reference time interval t1, respectively. By thus arranging, one combination of the scan control signals supplied to the pulse generating circuits $\mathbf{62}_1$ through $\mathbf{62}_{16}$ is switched to another combination per one reference time interval t1, and one pulse signal is selected among pulse signals $PS_1$ through $PS_{16}$ in accordance with the combination so as to be supplied to output signal lines $\mathbf{63}_1$ through $\mathbf{63}_{16}$.

Incidentally, display in accordance with high-definition image signals has recently been demanded with respect to the matrix-type image display device, and this has led to development of, for example, SVGA, XGA, and high-definition televisions. In such cases, as the numbers of the data signal lines 51 and the scanning signal lines 52 increase, the SCS lines 61 and the input terminals of the pulse generating circuits 62 accordingly increase.

The increase in the number of the input terminals of the pulse generating circuits 62 causes an increase in crossings of the SCS lines 61 and wires from the SCS lines 61 to the input terminals of the pulse generating circuits 62. As a result, parasitic capacitances of the SCS lines 61 increase.

Besides, the number of the SCS lines 61 itself increases, thereby, in combination with the increase in the parasitic capacitances, causing an increase in power consumption by the scanning circuit 55 as a whole.

Furthermore, the increase in the number of the SCS lines 61 and the increase in the number of the input terminals of the pulse generating circuits 62 cause the scanning circuit 55 to become bulky, thereby resulting in that miniaturization of the circuit becomes difficult.

SUMMARY OF THE INVENTION

The present invention is made in the light of the above-described problems, and the object of the present invention is to provide (1) a scanning circuit wherein the pulse generating circuits have less input terminals and crossings of the SCS lines and the wires from the SCS lines to the pulse generating circuits are reduced, thereby enabling reduction of power consumption and miniaturization of the circuit, and (2) to provide a matrix-type image display device incorporating the scanning circuit.

To achieve the above object, the scanning circuit of the present invention includes (1) a plurality of scan control signal lines to which scan control signals differing from one another are inputted, and (2) a plurality of pulse generating circuits, each pulse generating circuit outputting a different pulse signal based on a logical computation on scan control signals respectively supplied from m scan control signal lines selected among said scan control signal lines, combinations of the m scan control signal lines differing from one another, wherein (i) said scan control signal lines are divided into m scan control signal line groups so that the scan control signal line groups respectively correspond to m groups of signals supplied to the scan control signal lines, each of at least m−1 groups among the m groups being composed of three or four scan control signals differing in phases, and (ii) one scan control signal line is selected in each scan control signal line group so as to constitute each combination of the m scan control signal lines for supplying the scan control signals to each pulse generating circuit.

According to the above arrangement, m groups of signals which respectively correspond to the m SCS line groups are inputted to the SCS line groups. Among the m groups of signals, each of at least m−1 groups is composed of three or four signals differing in phases, and the three or four signals of each group are respectively supplied to the SCS lines of the corresponding group. This is realized by, for example, using m counters which are arranged as follows; with respect to signals corresponding to at least m−1 groups of signals, counting is carried out by a ternary system or a quaternary system, and the signal thus generated by the counter is supplied to the SCS lines so that the m groups of signals correspond to the SCS line groups, respectively.

On the other hand, m SCS lines for sending signals to each pulse generating circuit are selected so that one is selected in each SCS line group. By arranging the scanning circuit so that each pulse generating circuit outputs a pulse signal based on a logical computation on the scan control signals inputted thereto, the pulse signals are sequentially outputted from the scanning circuit in an order and direction in accordance with a predetermined scanning order and direction.

With the above-described arrangement, the number of the input terminals of the pulse generating circuits and the number of the crossings of the SCS lines and the wires from the SCS lines to the pulse generating circuits can be reduced without increasing the SCS lines in comparison with the conventional scanning circuit, thereby enabling reduction of power consumption by the circuit and miniaturization of the circuit, as described below.

Besides, the decrease in the number of the input terminals of the pulse generating circuit leads to simplification of the pulse generating circuit configuration, thereby resulting in that the scanning circuit operates at a higher speed. Furthermore, regarding most of the SCS signal lines, it is possible to lower frequencies of signals supplied thereto, thereby enabling to further reduce power consumption by the SCS lines.

In addition, in the above-described arrangement, it is preferable that (1) in each scan control signal line group, signals supplied to the scan control signal lines belonging the same have a same cycle and duty ratio, and (2) given that the i'th ($i \leqq m$) scan control signal line group has n(i) scan control signal lines, each of scan control signals supplied to the scan control signals of the i'th scan control signal line group has, during a scanning period, a cycle n(i) times as great as that of a signal supplied to the (i−1)'th scan control signal line group during the scanning period. By supplying the signals thus arranged to the SCS lines, necessary scanning operations can be carried out, without a hitch, by the scanning circuit which realizes miniaturization of the circuit and reduction of power consumption.

Furthermore, in the above arrangement, it is preferable that at least m−1 scan control signal line groups have a same number of the scan control signal lines each. By doing so, the circuits for generating signals to be supplied to the respective SCS line groups can be arranged so as to have substantially the same configurations, thereby resulting in simplification of the scanning circuit configuration.

Besides, in the above arrangement, it is preferable that a scan control signal generating circuit is provided for supplying signals to the scan control signal lines in response to an operation control signal for controlling the start/stop of the scanning operation and a timing control clock for controlling scanning timings. By thus providing the SCS generating circuit, the interface to outside can be reduced.

Furthermore, to achieve the object which is described earlier, a matrix-type image display device of the present invention has (1) pixels for display, provided in matrix, (2) a plurality of data signal lines for supplying image signals to the pixels, (3) a plurality of scanning signal lines being sequentially selected for sequential supply of data to the pixels, the scanning signal lines being provided orthogonal to the data signal lines, (4) a data signal line driving circuit for outputting image signals to the data signal lines, and (5) a scanning signal line driving circuit for supplying scanning signals to the scanning signal lines, wherein at least either the data signal line driving circuit or the scanning signal line driving circuit has a scanning circuit having any one of the above-described arrangements.

In other words, power consumption in the whole image display device can be reduced by providing, in at least either the data signal line driving circuit or the scanning signal line driving circuit, a scanning circuit having any one of the above-described arrangements with which the reduction of power consumption and the miniaturization of the circuit can be realized.

Here, the scanning circuit of the present invention will be described in detail below.

Given the number m of the SCS line groups and the number n(i) of the SCS lines in the i'th SCS line group, the total number L of the SCS lines and the maximum number x of the outputs of the scanning circuit of the present invention are given as:

$$\sum_{i=1}^{m} n(i) = L$$

$$\prod_{i=1}^{m} n(i) = x$$

Given that the number of the SCS line groups having three SCS lines each is a, the number of the SCS line groups having four SCS lines each is b, and the number of the SCS lines of the other SCS line group, which is at most one, is c (c=0, 2, 5, 6), the following equations can be obtained:

$$\sum_{i=1}^{m} n(i) = L = 3 \times a + 4 \times b + c$$

$$\prod_{i=1}^{m} n(i) = x = 3^a \times 4^b \times c \quad \ldots \text{ when } c \neq 0$$

$$= 3^a \times 4^b \quad \ldots \text{ when } c = 0$$

On the other hand, the maximum number y of the outputs of the conventional scanning circuit having the same number of SCS lines is given as:

$$y = 2^{(3a+4b+c)/2} = \left(2\sqrt{2}\right)^a \times 4^b \times \left(\sqrt{2}\right)^c$$

Therefore, in the case where c=0 or c=2, the following is found:

$$y = (2\sqrt{2})^a \times 4^b \le 3^a \times 4^b = x \quad \ldots \text{ when } c = 0$$

(equal when $a = 0$)

$$y = (2\sqrt{2})^a \times 4^b \times 2 \le 3^a \times 4^b \times 2 = x \quad \ldots \text{ when } c = 2$$

(equal when $a = 0$)

Thus, in the case where the scanning circuit of the present invention has the same number of the SCS lines as the conventional scanning circuit has, the maximum number of the outputs of the scanning circuit of the present invention is always either greater than or equal to that of the conventional scanning circuit. In other words, in the case where the numbers of the outputs are the same, the number of the SCS lines of the scanning circuit of the present invention is equal to or below that of the conventional scanning circuit.

Besides, the maximum number y' of outputs of another conventional scanning circuit having SCS lines whose total number is lessened by one in comparison with the former conventional scanning circuit is expressed as follows:

$$y' = 2^{\frac{(3a+4b+c-1)}{2}} = (2\sqrt{2})^a \times 4^b \times (\sqrt{2})^{c-1}$$

Therefore, even in the case where C=5 or c=6, the following can be found:

$$y' = (2\sqrt{2})^a \times 4^b \times (\sqrt{2})^{c-1} \le 3^a \times 4^b \times (\sqrt{2})^{c-1} < 3^a \times 4^b c \quad (\because c = 5, 6)$$

Consequently, in the case where the number z of the outputs, which the scanning circuit is required to have, satisfies y'<z≦y, the total number of the SCS lines of the scanning circuit of the present invention is equal to or smaller than that of the conventional circuit In addition, whereas the number of input terminals of pulse generating circuits of the conventional scanning circuit is (3×a+4×b+c)/2, the number of the input terminals of the pulse generating circuits of the scanning circuit of the present invention is given as:

a+b . . . when c=0 a+b+1 . . . when c≠0

Therefore, when a≧2 or b≧1, the number of the input terminals of the pulse generating circuits of the present invention is less than that of the conventional one.

Furthermore, in the case where the SCS line groups are provided from the farthest position to the closest position to the pulse generating circuits, like in the conventional scanning circuit shown in FIG. 15, the number of crossings of one signal line in the i'th SCS line group is found as follows. The number of the crossings of the one signal line and the wires from the signal lines of the first through (i−1)'th SCS line groups to the pulse generating circuits is given as:

$$(i-1) \times \prod_{k=1}^{m} n(k)$$

On the other hand, the number of the crossings of the signal lines of the i'th through m'th SCS line groups and the wires from the one signal line to the pulse generating circuits are given as:

$$\left(\sum_{k=i}^{m} n(k) - 1\right) \times \prod_{k=1}^{m} n(k) \div n(i)$$

Therefore, the number of crossings which one signal line in the i'th SCS line group has is found as:

$$\begin{aligned}
\left((i-1) \times n(i) + \sum_{k=i}^{m} n(k) - 1\right) \times \frac{\prod_{k=1}^{m} n(k)}{n(i)} &= \left(i \times n(i) - 1 + \sum_{k=i}^{m} n(k) - n(i)\right) \times \frac{\prod_{k=1}^{m} n(k)}{n(i)} \\
&= \left(i \times n(i) - 1 + \sum_{k=i+1}^{m} n(k)\right) \times \frac{\prod_{k=1}^{m} n(k)}{n(i)} \\
&= \left(i \times n(i) - 1 + L - \sum_{k=1}^{i} n(k)\right) \times \frac{\prod_{k=1}^{m} n(k)}{n(i)} \qquad \left(\because \sum_{k=i+1}^{m} n(k) = L - \sum_{k=1}^{i} n(k)\right) \\
&= \left(L - 1 + i \times n(i) - \sum_{k=1}^{i} n(k)\right) \times \frac{x}{n(i)} \qquad \left(\because \prod_{k=1}^{m} n(k) = x\right)
\end{aligned}$$

In the conventional arrangement, the number of crossings of the SCS lines and the wires therefrom to the pulse generating circuits is given as:

(L−1)×x/2

Therefore, when the number n(i) of signal lines of each SCS line group is set so as to satisfy:

n(1)>2; and when i≧2, $$i \times n(i) - \sum_{k=1}^{i} n(k) < 0$$

the following expressions can be obtained:

$$\left(L-1+\times n(1)-\sum_{k=1}^{1} n(k)\right)\times\frac{x}{n(1)}=(L-1+n(1)-n(1))\times\frac{x}{n(l)}$$
$$=(L-1)\times\frac{x}{n(1)}$$
$$<(L-1)\times\frac{x}{2}$$
$$\ldots \text{ when } i=1$$

$$\left(L-1+i\times n(i)-\sum_{k=1}^{i} n(k)\right)\times\frac{x}{n(i)}<(L-1)\times\frac{x}{n(i)}\leq(L-1)\times\frac{x}{2}$$
$$\ldots \text{ when } i\geq 2$$

As is clear from the above expressions, the number of the crossings of the SCS lines and the wires therefrom to the pulse generating circuits in the scanning circuit of the present invention can be reduced, in comparison with the conventional arrangement.

To be more specific, in order that i and j (i<j) satisfy n(i)>n(j), the SCS line group farthest from the pulse generating circuits should be arranged so as to have the maximum number of signal lines and the number of signal lines should be reduced as the SCS line group becomes closer to the pulse generating circuits.

As described above, in the scanning circuit of the present invention, it is possible to reduce the number of the input terminals of the pulse generating circuits and to reduce the crossings of the SCS lines and the wires therefrom to the pulse generating circuits, without increasing the number of the SCS lines, in comparison with the conventional scanning circuit, thereby enabling to scale down the circuit and to decrease the power consumption. Besides, the decrease of the input terminals of the pulse generating circuits leads to simplification of the structure of the pulse generating circuits, thereby causing the scanning circuit to operate at a high speed.

In the case where, in the scanning circuit of the present invention, the SCS line groups are arranged so as to have the same number, three, of SCS lines each, the total number L of the SCS lines and the maximum number x of the outputs of the scanning circuit are given as:

$$\sum_{i=1}^{m} n(i)=3\times m=L$$

$$\prod_{i=1}^{m} n(i)=3^m=3^{\frac{L}{3}}=\left(\sqrt[3]{3}\right)^L=x$$

On the other hand, in the case of the conventional scanning circuit having the same number of the SCS lines, the maximum number y of the outputs is given as:

$$y=2^{\frac{L}{2}}=\left(\sqrt{2}\right)^L$$

Therefore, the following can be found:

$$y=\left(\sqrt{2}\right)^L<\left(\sqrt[3]{3}\right)^L=x$$

Thus, the maximum number of the outputs of the scanning circuit of the present invention is always greater than that of the conventional scanning circuit having the same number of SCS lines. In other words, in the case where the scanning circuit of the present invention and the conventional scanning circuit have the same number of outputs each, the total number of the SCS lines of the former is smaller than that of the latter.

In the conventional scanning circuit, the number of the crossings of the SCS lines is given as:

$$(L-1)\times\frac{x}{2}$$

On the other hand, in the scanning circuit of the present invention, the number of the crossings of the signal lines of the i'th SCS line group is given as:

$$3\times(m-i)+i\times 3-1\times\frac{3^m}{3}=(L-1+i\times 3-i\times 3)\times\frac{x}{3}=(L-1)\times\frac{x}{3}$$

Therefore, the number of the crossings of the SCS lines and the wires therefrom to the pulse generating circuits in the scanning circuit of the present invention is two thirds of that in the conventional scanning circuit.

In the case where, in the scanning circuit of the present invention, the SCS line groups are arranged so as to have the same number, four, of SCS lines each, the total number L of the scS lines and the maximum number x of the outputs of the scanning circuit are given as:

$$\sum_{i=1}^{m} n(i)=4\times m=L$$

$$\prod_{i=1}^{m} n(i)=4^m=4^{\frac{L}{4}}=\left(\sqrt{2}\right)^L=x$$

Thus, the maximum number of the outputs of the scanning circuit of the present invention is always equal to that of the conventional scanning circuit having the same number of SCS lines. In other words, in the case where the numbers of outputs are the same, the total number of the SCS lines of the scanning circuit of the present invention is equal to that of the conventional scanning circuit.

On the other hand, the number of the crossings of the signal lines of the i'th SCS line group is given as:

$$4\times(m-i)+i+4-1\times\frac{4^m}{4}=(L-1+i\times 4-i\times 4)\times\frac{x}{4}=(L-1)\times\frac{x}{4}$$

Therefore, the number of the crossings of the SCS lines and the wires therefrom to the pulse generating circuits in the foregoing scanning circuit of the present invention is half of that of the conventional scanning circuit.

Thus, by arranging the scanning circuit of the present invention so that each SCS line group has the same number of the signal lines, it is enabled to reduce the number of crossings of the SCS lines and the wires therefrom to the pulse generating circuits, in comparison with the conventional scanning circuit.

Particularly, in the case where all the SCS line groups have three signal lines each, the total number of the SCS lines can be reduced, in comparison with the case of the conventional scanning circuit.

On the other hand, a sum S of the crossings of the SCS lines and the wires therefrom to the pulse generating circuits is given as:

$$S = \frac{1}{2} \times \sum_{i=1}^{m} \left( \left( L - 1 + i \times n(i) - \sum_{k=1}^{i} n(i) \right) \times \frac{x}{n(i)} \right)$$

Here, since the number of the crossings becomes minimum when i and j (i<j) satisfy n(i)>n(j), given that (1) the number of the SCS line groups having three SCS lines each, (2) the number of the SCS line groups having four SCS lines each, and (3) the number of the SCS lines of the other SCS line group, which is at most one, are a, b, and c (c=0, 2, 5, 6), respectively, S is expressed as follows when c=0:

$$S = \frac{1}{2} \times \left( (L-1) \times \frac{x}{4} \times b + (L-1-b) \times \frac{x}{3} \times a \right)$$
$$= \frac{x}{24} \times (3b \times (L-1) + 4a \times (L-1-b))$$

Here, b and L can be given as:

$$b = \frac{\log x}{\log 4} - \frac{\log 3}{\log 4} a = \alpha - \beta a \qquad (\because x = 3^a \times 4^b)$$

$$L = 3a + 4b = 3a + 4(\alpha - \beta a) \qquad \left( \because \alpha = \frac{\log x}{\log 4}, \beta = \frac{\log 3}{\log 4} \right)$$
$$= (3 - 4\beta)a + 4\alpha$$

Therefore, S is expressed as:

$$S = \frac{x}{24} \times (3 \times (\alpha - \beta a) \times ((3 - 4\beta)a + 4\alpha - 1) + 4a \times ((3 - 4\beta)a + 4\alpha - 1 - (\alpha - \beta a)))$$
$$= \frac{x}{24} \times (3 \times (4 - 7\beta + 4\beta^2) \times a^2 + (21\alpha - 24\alpha\beta + 3\beta - 4) \times a + 3\alpha \times (4\alpha - 1))$$

And hence, S becomes minimum when a satisfies:

$$a = -\frac{3\alpha \times (7 - 8\beta) + 3\beta - 4}{6 \times (4 - 7\beta + 4\beta^2)}$$
$$\approx -\frac{1.98 \times \alpha - 1.62}{6 \times 0.96} < 0 \qquad (\because \alpha \geq 1, \text{ since } x \geq 4)$$

Therefore, when a=0, that is, when all the SCS line groups are arranged so as to have four SCS lines each, the sum of the crossings of the SCS lines and the wires therefrom to the pulse generating circuits becomes minimum.

Likewise, when c=2, S is expressed as:

$$S = \frac{1}{2} \times \left( (L-1) \times \frac{x}{4} \times b + (L-1-b) \times \frac{x}{3} \times a + (L-1-2b-a) \times \frac{x}{a} \right)$$
$$= \frac{x}{24} \times (3b \times (L-1) + 4a \times (L-1-b) + 6 \times (L-1-2b-a))$$

Here, b and L can be given as:

$$b = \frac{\log x}{\log 4} - \frac{\log 3}{\log 4} a - \frac{\log 2}{\log 4} = \alpha - \beta a - \gamma \qquad (\because x = 3^a \times 4^b \times 2)$$

$$L = 3a + 4b + 2 = 3a + 4(\alpha - \beta a - \gamma) + 2$$
$$= (3 - 4\beta)a + 4(\alpha - \gamma) + 2$$
$$\left( \because \alpha = \frac{\log x}{\log 4}, \beta = \frac{\log 3}{\log 4}, \gamma = \frac{\log 2}{\log 4} = 0.5 \right)$$

Therefore, S is expressed as:

$$S = \frac{x}{24} \times (\alpha - \beta a - \gamma) \times ((3 - 4\beta)a + 4(\alpha - \gamma) + 1) + 4a \times ((3 - 4\beta)\alpha + 4(\alpha - \gamma) + 1 - (\alpha - \beta a - \gamma)) + 6 \times ((3 - 4\beta) \times \alpha + 4(\alpha - \gamma) + 1 - 2 \times (\alpha - \beta a - \gamma)))$$
$$= \frac{x}{24} \times (3 \times (4 - 7\beta + 4\beta^2) \times a^2 + ((21 - 24\beta) \times (\alpha - \gamma) - 15\beta + 16) \times a + 12 \times (\alpha - \gamma)^2 + 15(\alpha - \gamma) + 6)$$

And hence, S becomes minimum when a satisfies:

$$a = -\frac{3(\alpha - \gamma) \times (7 - 8\beta) - 15\beta + 16}{6 \times (4 - 7\beta + 4\beta^2)} = -\frac{3\alpha \times (7 - 8\beta) - 3\gamma \times (7 - 8\beta) - \beta + 16}{6 \times (4 - 7\beta + 4\beta^2)}$$
$$\approx -\frac{1.98 \times \alpha 1.73637}{6 \times 0.96} < 0 \qquad (\because \alpha \geq 1, \text{ since } x \geq 4)$$

Therefore, when a=0, that is, when all the SCS line groups except one are arranged so as to have four SCS lines each, the sum of the crossings of the SCS lines and the wires therefrom to the pulse generating circuits becomes minimum.

Likewise, when c=5 or 6, S is expressed as follows:

$$S = \frac{1}{2} \times \left( (L-1) \times \frac{x}{c} + \left( L - 1 - (c-4) \times \frac{x}{4} \times b + (L - 1 - (c-3) - b) \times \frac{x}{3} \right) \right)$$
$$= \frac{x}{24} \times (12 \times (L-1) + 3bc \times (L - c + 3) + 4ac \times (L - c + 2 - b))$$

Here, b and L can be given as:

$$b = \frac{\log x}{\log 4} - \frac{\log 3}{\log 4} a - \frac{\log c}{\log 4} = \alpha - \beta a - \gamma' \qquad (\because x = 3^a \times 4^b \times c)$$

$$L = 3a + 4b + c = 3a + 4(\alpha - \beta a - \gamma') + c$$
$$= (3 - 4\beta)a + 4(\alpha - \gamma') + c$$
$$\left( \because \alpha = \frac{\log x}{\log 4}, \beta = \frac{\log 3}{\log 4}, \gamma' = \frac{\log c}{\log 4} \right)$$

Therefore, S is given as:

$$S = \frac{x}{24} \times (12 \times ((3-4\beta)a + 4(\alpha-\gamma') + 1) + 3c \times ((\alpha - \beta a - \gamma') \times ((3-4\beta)a + 4(\alpha-\gamma') + 3) + 4ac \times ((3-4\beta) \times a + 4(\alpha-\gamma') + 2 - (\alpha - \beta a - \gamma')))$$

$$= \frac{x}{24} \times (3c \times (4 - 7\beta + 4\beta^2) \times a^2 + (12 \times (3-4\beta) - 3c \times (\alpha-\gamma') \times (7-8\beta) - 9c\beta + 8c) \times a + (\alpha-\gamma') \times (48 + 12c \times (\alpha-\gamma') + 9c) + 12 \times (c-1))$$

And hence, S becomes minimum when a satisfies:

$$a = -\frac{12 \times (3-4\beta) + 3(\alpha-\gamma') \times (7-8\beta) - 9c\beta + 8c}{6c \times (4 - 7\beta + 4\beta^2)}$$

$$= -\frac{3c\alpha \times (7-8\beta) + 12 \times (3-4\beta) - 3c\gamma' \times (7-8\beta) - 9c\beta + 8c}{6c \times (4 - 7\beta + 4\beta^2)}$$

$$\approx -\frac{9.90 \times \alpha - 13.79}{6 \times 5 \times 0.96} < 0 \quad (\text{when } c = 5) \quad (\because \alpha \geq 1, \text{ since } x \geq 4)$$

$$\approx -\frac{11.88 \times \alpha + 18.53}{6 \times 6 \times 0.96} < 0 \quad (\text{when } c = 6) \quad (\because \alpha \geq 1, \text{ since } x \geq 4)$$

Therefore, when a=0, that is, when all the SCS line groups except one are arranged so as to have four SCS lines each, the sum of the crossings of the SCS lines and the wires therefrom to the pulse generating circuits becomes minimum.

As has been described, by arranging so that at least m−1 SCS line groups have four signal lines each, it is enabled to minimize the sum of the crossings of the SCS lines and the wires therefrom to the pulse generating circuits.

In the case where all the SCS line groups are arranged so as to have three signal lines each, each signal sent to the i'th SCS line group has a frequency of $f \times 3^{-i}$, where f represents a scan frequency. Here, the three SCS lines of the SCS line group of the present invention correspond to SCS lines in two SCS line groups in the conventional arrangement, and the combination of two SCS line groups in the conventional arrangement which correspond to an odd-number'th SCS line group of the present invention is different from the combination of two SCS line groups in the conventional arrangement which correspond to an even-number'th SCS line group of the present invention. Therefore, in the case where i is an odd number, a signal supplied to one of the corresponding SCS lines in the conventional arrangement has a frequency of $f \times 2^{-(3i+1)/2}$ and those supplied to the other two have a frequency of $f \times 2^{-(3i-2)/2}$ each, whereas, in the case where i is an even number, a signal supplied to one of the corresponding SCS lines in the conventional arrangement has a frequency of $f \times 2^{-(3i-2)/2}$ and those supplied to the other two have a frequency of $f \times 2^{-3i/2}$ each.

Here, in the case where $i \geqq 6$, the following expression can be obtained:

$$2^{\frac{-(3i+1)}{2}} \geq \left(2\sqrt{2}\right)^{-(i-6)} \div 725 \geq 3^{-(i-6)} \div 729 = 3^{-i}$$

Therefore, in comparison with the conventional arrangement, each of the frequencies of the signals supplied to the SCS lines is lower. In the case where i<6, the following expression can be obtained, since $i \geqq 1$:

$$2^{\frac{-3i}{2}} = \left(2\sqrt{2}\right)^{-i} \geq 3^{-i}$$

Thus, signals supplied to five among the six SCS lines have frequencies each of which 4s lower than that in the conventional arrangement.

Furthermore, in the case where all the SCS line groups are arranged so as to have four signal lines each, each of the signals supplied to the i'th SCS line group has a frequency of $f \times 4^{-i}$, where f represents a scan frequency. Here, among signals supplied to four corresponding signal lines in the conventional arrangement, two have a frequency of $f \times 4^{-i}$ while the other two have a frequency of $f \times 2^{-(2i-1)}$.

In this case, since $2^{-(2i-1)} = 4^{-i} \times 2 \geqq 4^{-i}$, signals supplied to two among the four signal lines of the present invention have the same frequency as those supplied to corresponding signal lines in the conventional arrangement, whereas signals supplied to the other two of the present invention have a frequency lower than those supplied to equivalent signal lines in the conventional arrangement.

In other cases, most of the signals supplied to the SCS lines have frequencies lower than those supplied to corresponding signal lines in the conventional arrangement. Therefore, with the present invention, it is possible to reduce power consumed by the SCS lines.

The scanning circuit of the present invention having the above-described functions and effects can be described as follows. The scanning circuit of the present invention has L SCS lines, which are divided into m SCS line groups. Each SCS line group has 2 to 6 SCS lines, and at least m−1 SCS line groups among them have 3 to 4 SCS lines each. The scanning circuit has a plurality of pulse generating circuits, each of which outputs a pulse signal in accordance with a logical computation on signals supplied from m SCS lines. The m SCS lines for sending signals to each pulse generating circuit are selected so that one SCS line is selected from each SCS line group, so that combinations of the m SCS lines differ from each other. More preferably, signals supplied to the SCS lines in each SCS line group have the same cycle and duty ratio, and signals supplied to the i'th SCS line group having n(i) SCS lines have a duty ratio during the scanning period of not more than 1/n(i) and a cycle n(i) times as great as that of signals supplied to the (i−1)'th SCS line group. In the case where at least m−1 SCS line groups have the same number of SCS lines each, circuits for generating signals supplied to the SCS line groups may be arranged so as to have substantially the same configuration. Besides, by incorporating the SCS generating circuit for outputting signals to be supplied to the SCS lines in accordance with an operation control signal for controlling the start/stop of the scanning operation and a timing control clock for controlling scanning timings, it is enabled to reduce the interface with outside.

For a fuller understanding of the nature and advantages of the invention, reference should be made to the ensuing detailed description taken in conjunction with the accompanying drawings.

DESCRIPTION OF THE PREFERRED EMBODIMENTS

First Embodiment

Figure 1:
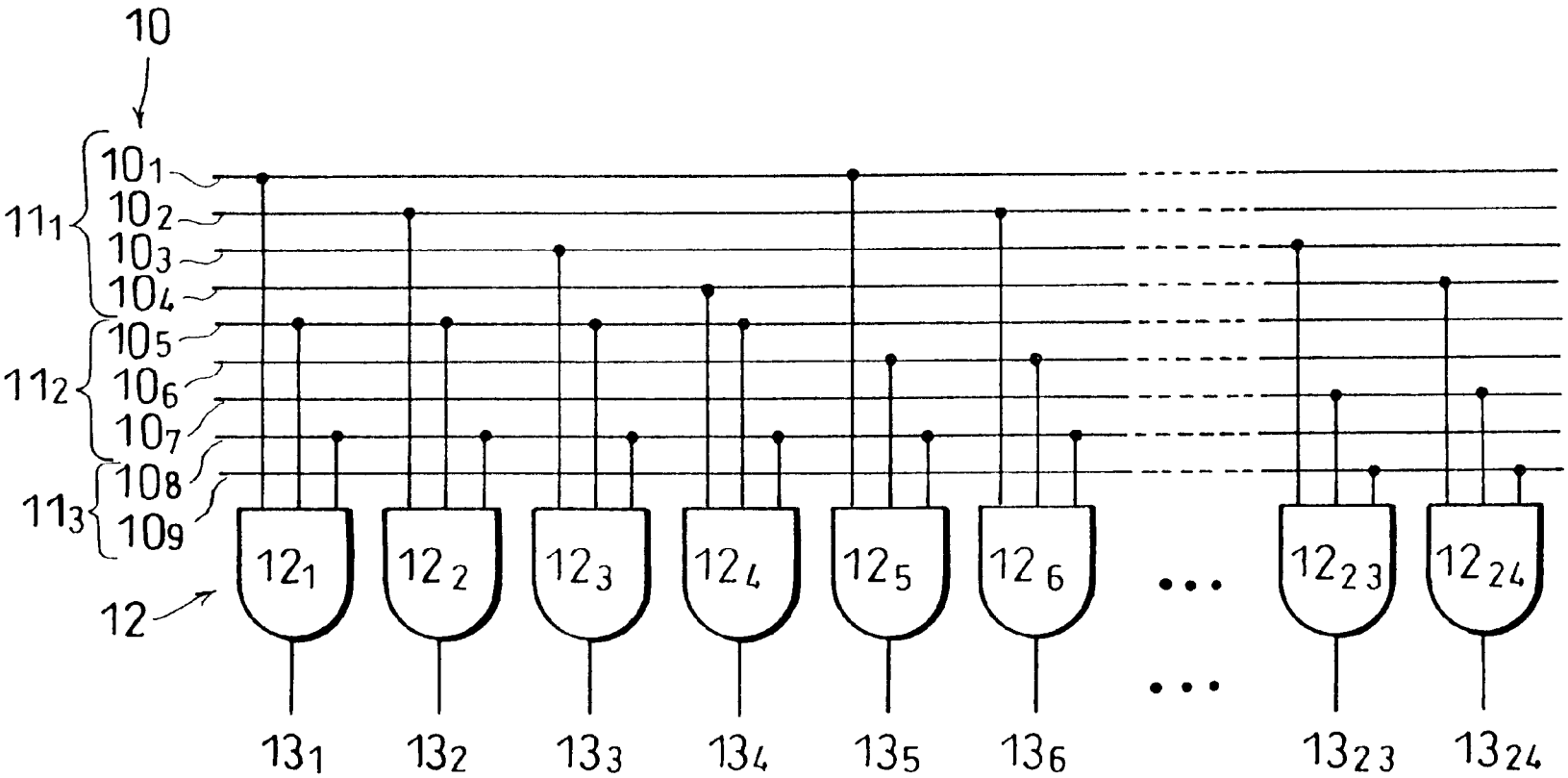
FIG. 1 is a circuit diagram illustrating a schematic arrangement of a scanning circuit of one embodiment of the present invention.
Figure 2:
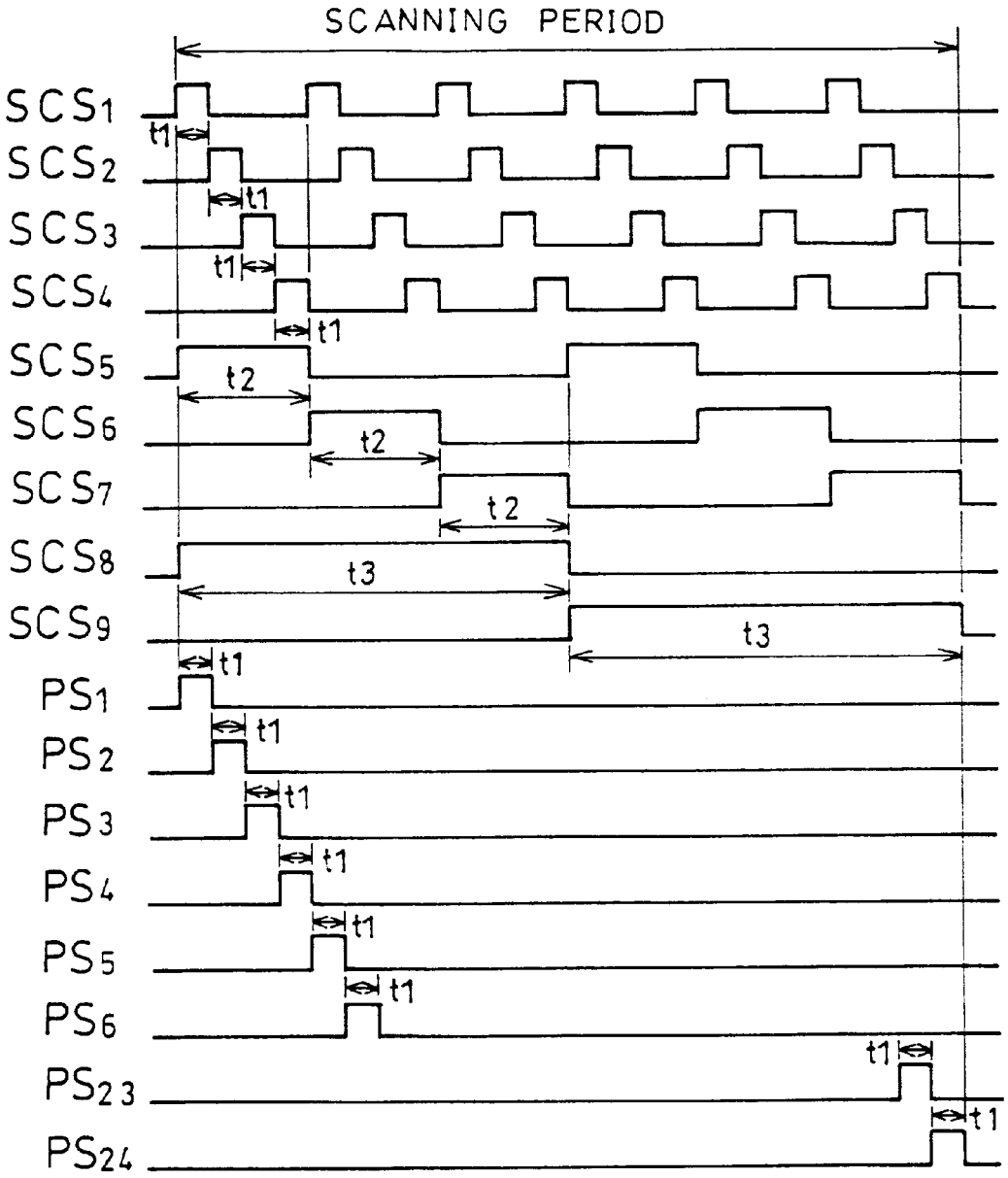
FIG. 2 is a timing chart illustrating scan control signals supplied to scan control signal lines and pulse signals outputted from pulse generating circuits in the scanning circuit.
Figure 3:
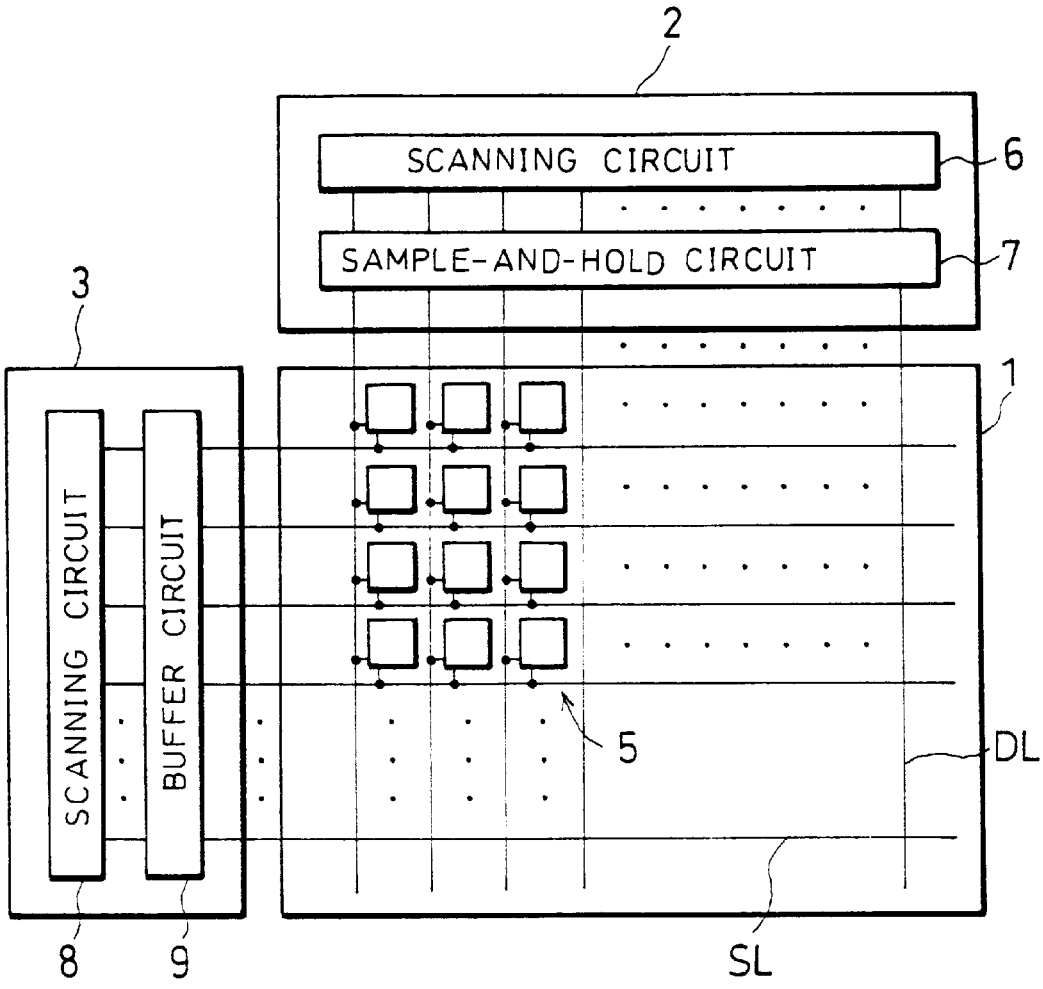
FIG. 3 is a view illustrating major parts of a liquid crystal display device incorporating the scanning circuit.

The following description will discuss an embodiment of the present invention, while referring to FIGS. 1 through 3.

A scanning circuit of the present embodiment is applied in a driving circuit provided in a matrix-type image display device such as a liquid crystal display device. A schematic arrangement of an active matrix-type liquid crystal display device as an example is illustrated in FIG. 3. The liquid crystal display device has (1) a liquid crystal panel 1 on which a plurality of data signal lines DL and a plurality of scanning signal lines SL are provided, (2) a data signal line driving circuit 2, and (3) a scanning signal line driving circuit 3. The liquid crystal panel 1 is composed of a pair of substrates between which liquid crystal is sealed in.

On one or both of the substrates of the liquid crystal panel 1, the data signal lines DL and the scanning signal lines SL are provided so as to be orthogonal to each other. In each region surrounded by neighboring data signal lines DL and neighboring scanning signal lines SL, one pixel 5 is provided. Therefore, the pixels 5 as a whole are provided in a matrix. By modulating the transmittance and reflectance of the liquid crystal in accordance with voltages applied to the pixels 5, display is carried out.

The data signal lines DL are connected to the data signal line driving circuit 2, so that data signals (image signals) to be supplied to the pixels 5 are supplied from the data signal line driving circuit 2 to the data signal lines DL. On the other hand, the scanning signal lines SL are connected to the scanning signal line driving circuit 3, so that scanning signals for selecting pixels 5 to receive the data signals from the data signal lines DL are supplied from the scanning signal line driving circuit 2 to the scanning signal lines SL.

The data signal line driving circuit 2 in corporates a scanning circuit 6 for sequentially outputting pulse signals at fixed intervals and a S/H circuit 7 for sampling and outputting the data signals supplied from outside in response t o the signals from the scanning circuit 6. On the other hand, the scanning signal line driving circuit 3 has a scanning circuit 8 and a buffer circuit 9 so as to sequentially output the scanning signals to the scanning signal lines SL. Note that in some cases these driving circuits 2 and 3 are provided integrally with the liquid crystal panel 1 so that the driving circuits 2 and 3 and the liquid crystal panel 1 share the substrates. As the scanning circuits 6 and 8 of the driving circuits 2 and 3, the scanning circuits of the present embodiment are used.

FIG. 1 is a circuit diagram illustrating a schematic arrangement of the scanning circuit of the present embodiment. Note that the figure is simplified for purposes of illustration, with a smaller number of signal lines, circuits, or the like. Therefore, there is no specific limitation on the number of the signal lines, circuits, or the like, which will be described below, and in a scanning circuit as a whole, actual numbers thereof may exceed the numbers described below.

The scanning circuit has nine SCS lines 10 ($\mathbf{10}_1$ through $\mathbf{10}_9$), and twenty-four pulse generating circuits 12 ($\mathbf{12}_1$ through $\mathbf{12}_{24}$). The SCS lines 10 are divided into three scan control signal line groups (hereinafter referred to as SCS line groups) $\mathbf{11}_1$ through $\mathbf{11}_3$.

FIG. 2 is a timing chart illustrating signal waveforms applied to respective parts of the scanning circuit. During a scanning period, scan control signals $SCS_1$ through $SCS_4$ are inputted to the signal lines $\mathbf{10}_1$ through $\mathbf{10}_4$ of the SCS line group $\mathbf{11}_1$, respectively. Namely, inputted to the signal lines $\mathbf{10}_1$ through $\mathbf{10}_4$ are the signals arranged so that each has a pulse width of t1 and a cycle of t2 (=t1×4) and a rising timing difference between any signals supplied to neighboring signal lines 10 is t1. Likewise, during the scanning period, scan control signals $SCS_5$ through $SCS_7$ are inputted to the signal lines $\mathbf{10}_5$ through $\mathbf{10}_7$ of the SCS line groups $\mathbf{11}_2$, respectively. Namely, inputted to the signal lines $\mathbf{10}_5$ through $\mathbf{10}_7$ are the signals arranged so that each has a pulse width of t2 (=t1×4) and a cycle of t3 (=t2×3=t1×12) and a rising timing difference between any signals supplied to neighboring signal lines 10 is t2. The signals have rising and falling timings in synchronization with rising timings of one of the signals supplied to the SCS line group $\mathbf{11}_1$. Likewise, during the scanning period, scan control signals $SCS_8$ and $SCS_9$ are inputted to the signal lines $\mathbf{10}_8$ and $\mathbf{10}_9$ of the SCS line groups $\mathbf{11}_3$, respectively. Namely, inputted to the signal lines $\mathbf{10}_8$ and $\mathbf{10}_9$ are the signals arranged so that each has a pulse width of t3 (=t2×3=t1×12) and a cycle of t3×2

(=t2×6=t1×24) and a rising timing difference between the signals supplied to the neighboring signal lines 10 is t3. The signals have rising and falling timings in synchronization with rising timings of one of the signals supplied to the SCS line group $\mathbf{11}_2$. With this arrangement, at any time, three SCS lines 10 which are respectively selected from the SCS line groups $\mathbf{11}_1$ through $\mathbf{11}_3$ are supplied with signals at a high (Hi) level. The combination of the three SCS lines changes per one reference time interval t1, and all the combinations during one scanning period differ from one another.

Thus, three SCS lines 10 are respectively selected from the SCS line groups $\mathbf{11}_1$ through $\mathbf{11}_3$, so that the combinations are different, and the SCS lines in each combination are connected to each pulse generating circuit 12 through wires. In other words, supplied to each pulse generating circuit 12 are signals sent through three SCS lines 10 which are respectively selected from the SCS line groups $\mathbf{11}_1$ through $\mathbf{11}_3$. Then, at each pulse generating circuit 12, a logical computation is applied with respect to the inputted signals, and an AND signal of the inputted signals is outputted.

Thus, the different combinations of the SCS lines 10 for sending signals to the pulse generating circuits 12 are respectively connected to the pulse generating circuits 12, and the combinations respectively correspond to the combinations of SCS lines 10 receiving signals at a "Hi" level. Therefore, pulse signals are sequentially outputted from the pulse generating circuits 12, one pulse during each reference time interval t1. In other words, the combination of the scan control signals supplied to the pulse generating circuits $\mathbf{12}_1$ through $\mathbf{12}_{24}$ changes per reference time interval t1, and pulse signals $PS_1$ through $PS_{24}$ in accordance with the combinations of the scan control signals to output lines $\mathbf{13}_1$ through $\mathbf{13}_{24}$ are outputted from the pulse generating circuits $\mathbf{12}_1$ through $\mathbf{12}_{24}$, respectively.

Thus, the above-described scanning circuit has nine SCS lines 10, three input terminals of each pulse generating circuit 12, and twenty-four pulse generating circuits 12, that is, twenty-four outputs of the scanning circuit. In the case of a conventional scanning circuit having the same number of outputs, L which represents the number of necessary SCS lines is required to satisfy L=2×m and $2^{m-1}<24\leqq 2^m$. Since $2^4<24\leqq 2^5$, it is found that m=5. Therefore, it is found that in the scanning circuit of the above conventional arrangement, ten SCS lines and five input terminals of each pulse generating circuit are provided. Thus, the respective numbers of the SCS lines 10 and the input terminals of the pulse generating circuits 12 are reduced in the scanning circuit of the present embodiment, in comparison with the conventional arrangement.

On the other hand, the number of crossings which one SCS line 10 has with respect to the wires from the SCS lines 10 to the pulse generating circuits 12 is found by using the following formula:

$$\left(L-1+i\times n(i)-\sum_{k=1}^{i} n(k)\right)\times\frac{x}{n(i)}=\left(8+i\times n(i)-\sum_{k=1}^{i} n(k)\right)\times\frac{24}{n(i)}$$

Therefore, one SCS line of the SCS line group $\mathbf{11}_1$, one SCS line of the SCS line group $\mathbf{11}_2$, and one SCS line of the SCS line group $\mathbf{11}_3$ have the following numbers of crossings, respectively:

$$(8+1\times4-4)\times24/4=8\times6=48$$

$$(8+2\times3-7)\times24/3=7\times8=56$$

$$(8+3\times2-9)\times24/2=5\times12=60$$

Therefore, the sum of the crossings of the scanning circuit is found as:

$$48\times4+56\times3+60\times2=480$$

On the other hand, regarding the conventional scanning circuit, the number of crossings which one SCS line has with respect to the wires from the SCS lines to the pulse generating circuits is found as:

$$(L-1)\times x/2=(10-1)\times24/2=9\times12=108$$

Therefore, the sum of the crossings is 108×10=1080.

Consequently, the scanning circuit of the present embodiment has a smaller number of crossings of the SCS lines 10 and the wires from the SCS lines 10 to the pulse generating circuits 12, in comparison with the conventional scanning circuit.

As has been so far described, in the case of the scanning circuit of the present embodiment, the respective numbers of (1) the SCS lines 10, (2) the input terminals of each pulse generating circuit 12, and (3) the crossings of the SCS lines 10 and the wires from the SCS lines 10 to the pulse generating circuits 12 are reduced, as compared with the conventional scanning circuit. Therefore, it is possible to reduce power consumption of the circuit and to scale down the circuit.

Furthermore, by applying the scanning circuit of the present embodiment to a matrix-type image display device of the above-described arrangement or another arrangement, it is possible to reduce power consumption of the whole device, and to scale down the data signal line driving circuit 2 and the scanning signal line driving circuit 3.

Second Embodiment

Figure 4:
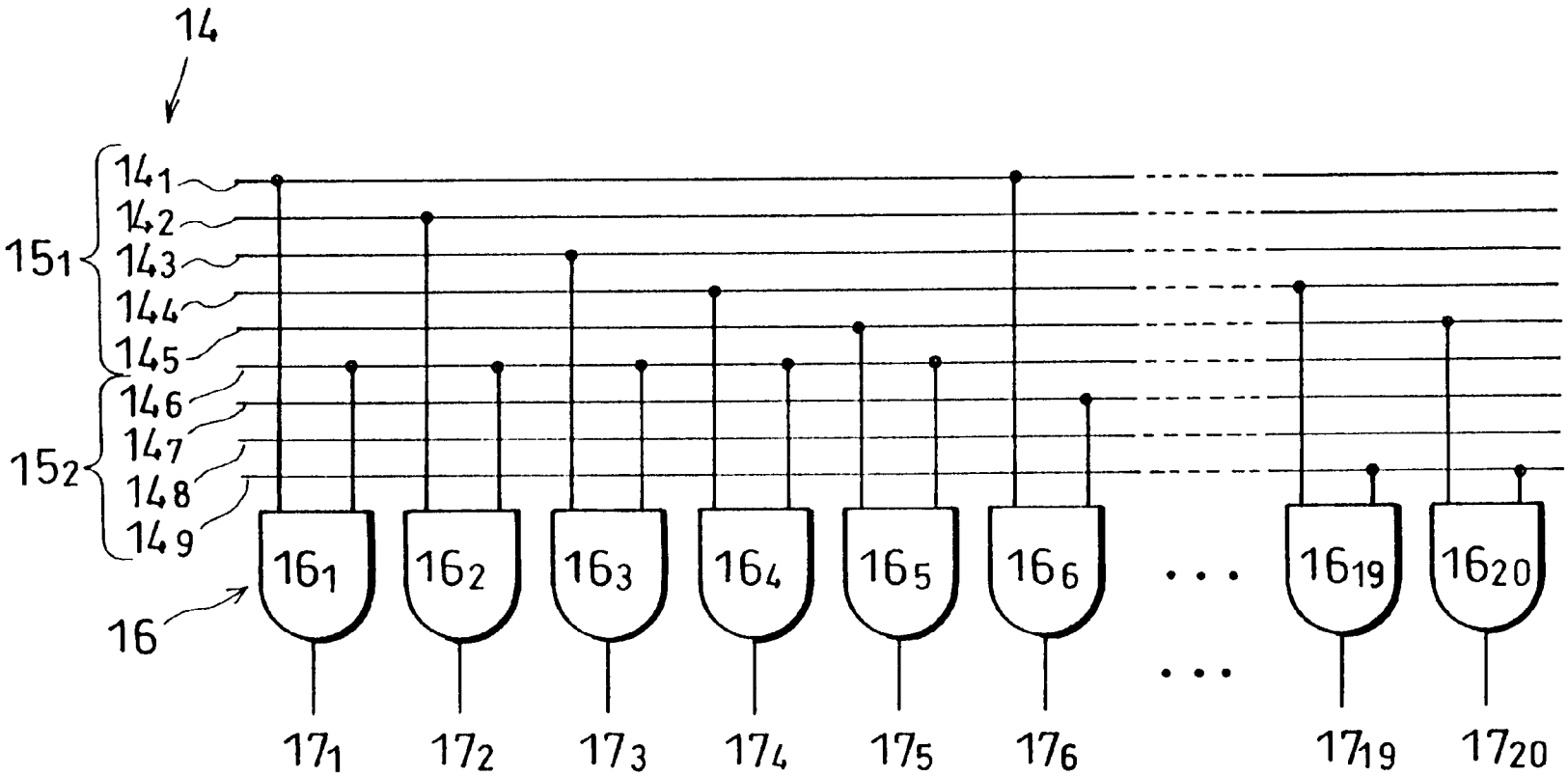
FIG. 4 is a circuit diagram illustrating a schematic arrangement of the scanning circuit of another embodiment of the present invention.
Figure 5:
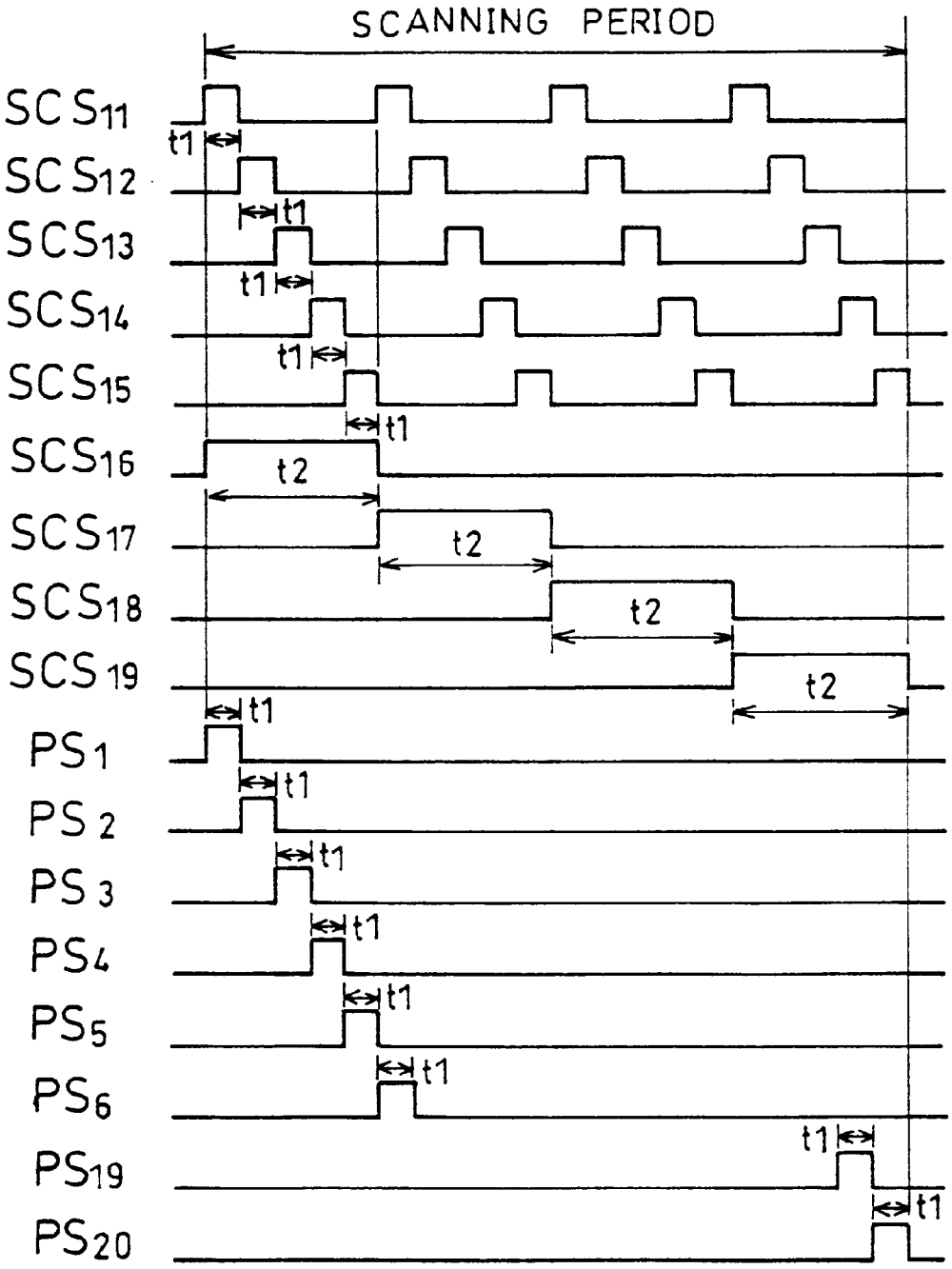
FIG. 5 is a timing chart illustrating scan control signals supplied to scan control signal lines and pulse signals outputted from pulse generating circuits in the scanning circuit.

The following description will discuss another embodiment of the present invention, while referring to FIGS. 4 and 5. The members having the same structure (function) as those in the above-mentioned embodiment will be designated by the same reference numerals and their description will be omitted.

FIG. 4 is a circuit diagram illustrating a schematic arrangement of a scanning circuit of the present embodiment. Note that the figure is simplified for purposes of illustration, with a smaller number of signal lines, circuits, or the like. Therefore, there is no specific limitation on the number of the signal lines, circuits, or the like, which will be described below, and in a scanning circuit as a whole, actual numbers thereof may exceed the numbers described below.

The scanning circuit has nine SCS lines 14 ($\mathbf{14}_1$ through $\mathbf{14}_9$), and twenty pulse generating circuits 16 ($\mathbf{16}_1$ through $\mathbf{16}_{20}$). The SCS lines 14 are divided into two SCS line groups $\mathbf{15}_1$ and $\mathbf{15}_2$.

FIG. 5 is a timing chart illustrating signal waveforms applied to respective parts of the scanning circuit. During a scanning period, scan control signals $SCS_{11}$ through $SCS_{15}$ are inputted to the signal lines $\mathbf{14}_1$ through $\mathbf{14}_5$ of the SCS line group $\mathbf{15}_1$, respectively. Namely, inputted to the signal lines $\mathbf{14}_1$ through $\mathbf{14}_5$ are the signals arranged so that has a pulse width of t1 and a cycle of t2 (=t1×5) and a rising timing difference between any signals supplied to neighboring signal lines 14 is t1. Likewise, during the scanning period, scan control signals $SCS_{16}$ through $SCS_{19}$ are inputted to the signal lines $\mathbf{14}_6$ through $\mathbf{14}_9$ of the SCS line group $\mathbf{15}_2$, respectively. Namely, inputted to the signal lines $\mathbf{14}_6$ through $14_9$ are the signals arranged so that each has a pulse width of t2 (=t1×5) and a cycle of t3 (=t2×4=t1×20), and a rising timing difference between any signals supplied to neighboring SCS lines 14 is t2. The signals have rising and falling timings in synchronization with rising timings of one of the signals supplied to the SCS line group $15_1$. With this arrangement, at any time, two SCS lines 14 which are respectively from the SCS line groups $15_1$ and $15_2$ are supplied with signals at a "Hi" level. The combination of the two SCS lines changes per one reference time interval t1, and all the combinations during one scanning period differ from one another.

Thus, two SCS lines 14 are respectively selected from the SCS line groups $15_1$ and $15_2$, so that the combinations are different, and the SCS lines in each combination are connected to each pulse generating circuit 16 through wires. In other words, supplied to each pulse generating circuit 16 are signals sent through two SCS lines 14 which are respectively selected from the SCS line groups $15_1$ and $15_2$. Then, at each pulse generating circuit 16, a logical computation is applied with respect to the inputted signals, and an AND signal of the inputted signals is outputted.

Thus, the different combinations of the SCS lines 14 for sending signals to the pulse generating circuits 16 are respectively connected to the pulse generating circuits 16, and the combinations respectively correspond to the combinations of SCS lines 14 receiving signals at a "Hi" level. Therefore, pulse signals are sequentially outputted from the pulse generating circuits 16, one pulse during each reference time interval t1. In other words, the combination of the scan control signals supplied to the pulse generating circuits $16_1$ through $16_{20}$ changes per reference time interval t1, and pulse signals $PS_1$ through $PS_{20}$ in accordance with the combinations of the scan control signals are outputted from the pulse generating circuits $16_1$ through $16_{20}$ to output lines $17_1$ through $17_{20}$, respectively.

Thus, the above-described scanning circuit has nine SCS lines 14, two input terminals of each pulse generating circuit 16, and twenty pulse generating circuits 16, that is, twenty outputs of the scanning circuit. In the case of a conventional scanning circuit having the same number of outputs, L which represents the number of necessary SCS lines is required to satisfy L=2×m and $2^{m-1}<20\leqq 2^m$. Since $2^4<20\leqq 2^5$, it is found that m=5. Therefore, it is found that in the scanning circuit of the above conventional arrangement, ten SCS lines and five input terminals of each pulse generating circuit are provided. Thus, the respective numbers of the SCS lines 14 and the input terminals of the pulse generating circuits 16 are reduced in the scanning circuit of the present embodiment, in comparison with the conventional arrangement.

On the other hand, the number of crossings which one SCS line 14 has with respect to the wires from the SCS lines 14 to the pulse generating circuits 16 is found by using the following formula:

$$\left(L-1+i\times n(i)-\sum_{k=1}^{i} n(k)\right)\times\frac{x}{n(i)}=\left(8+i\times n(i)-\sum_{k=1}^{i} n(k)\right)\times\frac{20}{n(i)}$$

Therefore, one SCS line of the SCS line group $15_1$ and one SCS line of the SCS line group $15_2$ have the following numbers of crossings, respectively:

$$(8+1\times5-5)\times20/5=8\times4=32$$

$$(8+2\times4-9)\times20/4=7\times5=36$$

On the other hand, regarding the conventional scanning circuit, the number of crossings which one SCS line has with respect to the wires from the SCS lines to the pulse generating circuits is found as:

$$(L-1)\times x/2=(10-1)\times20/2=9\times10=90$$

Therefore, the scanning circuit of the present embodiment has a smaller number of crossings of the SCS lines 14 and the wires from the SCS lines 14 to the pulse generating circuits 16, in comparison with the conventional scanning circuit.

As has been so far described, in the case of the scanning circuit of the present embodiment, the respective numbers of (1) the SCS lines 14, (2) the input terminals of each pulse generating circuit 16, and (3) the crossings of the SCS lines and the wires from the SCS lines 14 to the pulse generating circuits 16 are reduced, as compared with the conventional scanning circuit. Therefore, it is possible to reduce power consumption of the circuit and to scale down the circuit.

Furthermore, by applying the scanning circuit of the present embodiment to a matrix-type image display device of the arrangement earlier described or another arrangement, it is possible to reduce power consumption of the whole device, and to scale down the data signal line driving circuit 2 and the scanning signal line driving circuit 3.

Third Embodiment

Figure 6:
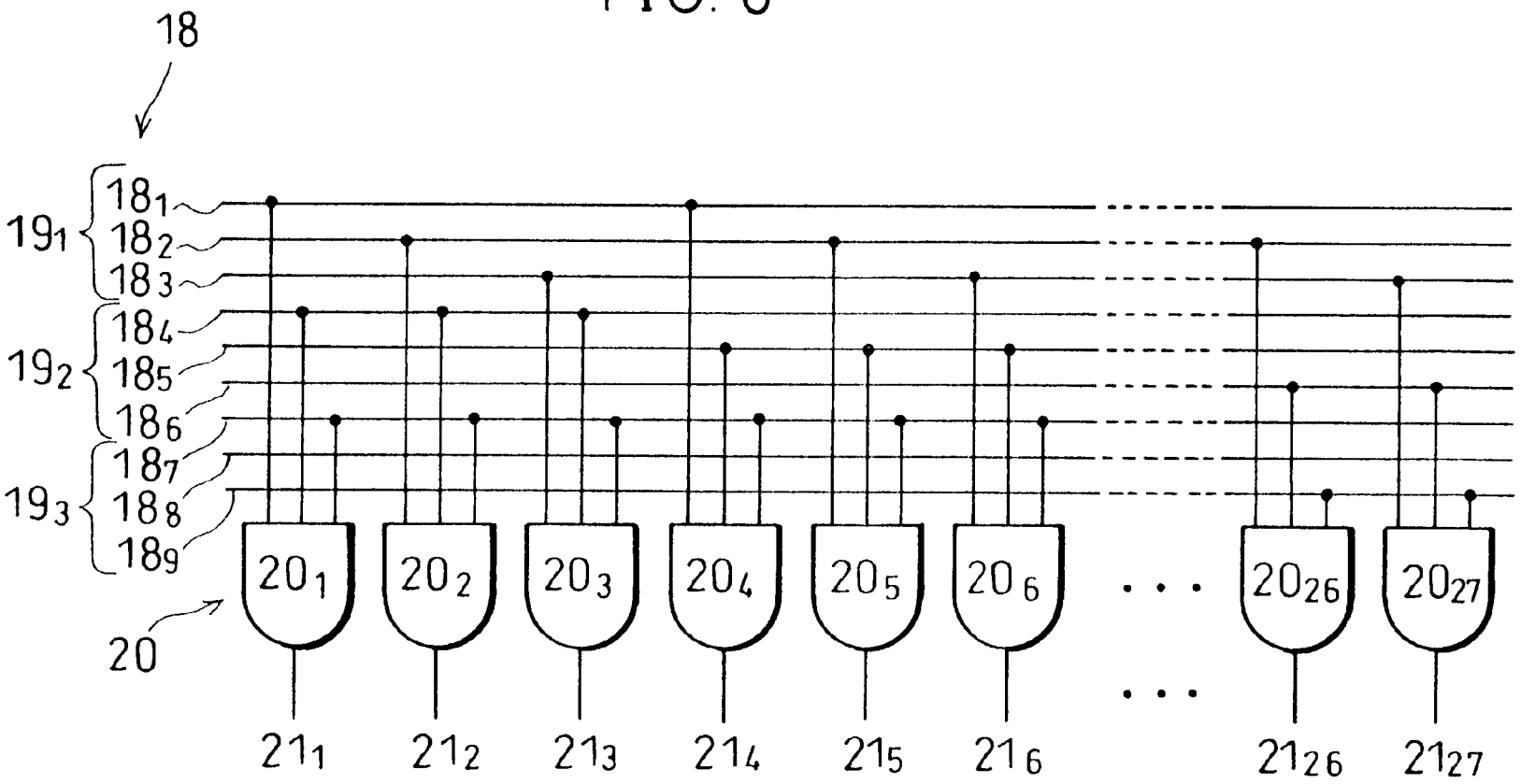
FIG. 6 is a circuit diagram illustrating a schematic arrangement of a scanning circuit of still another embodiment of the present invention.
Figure 7:
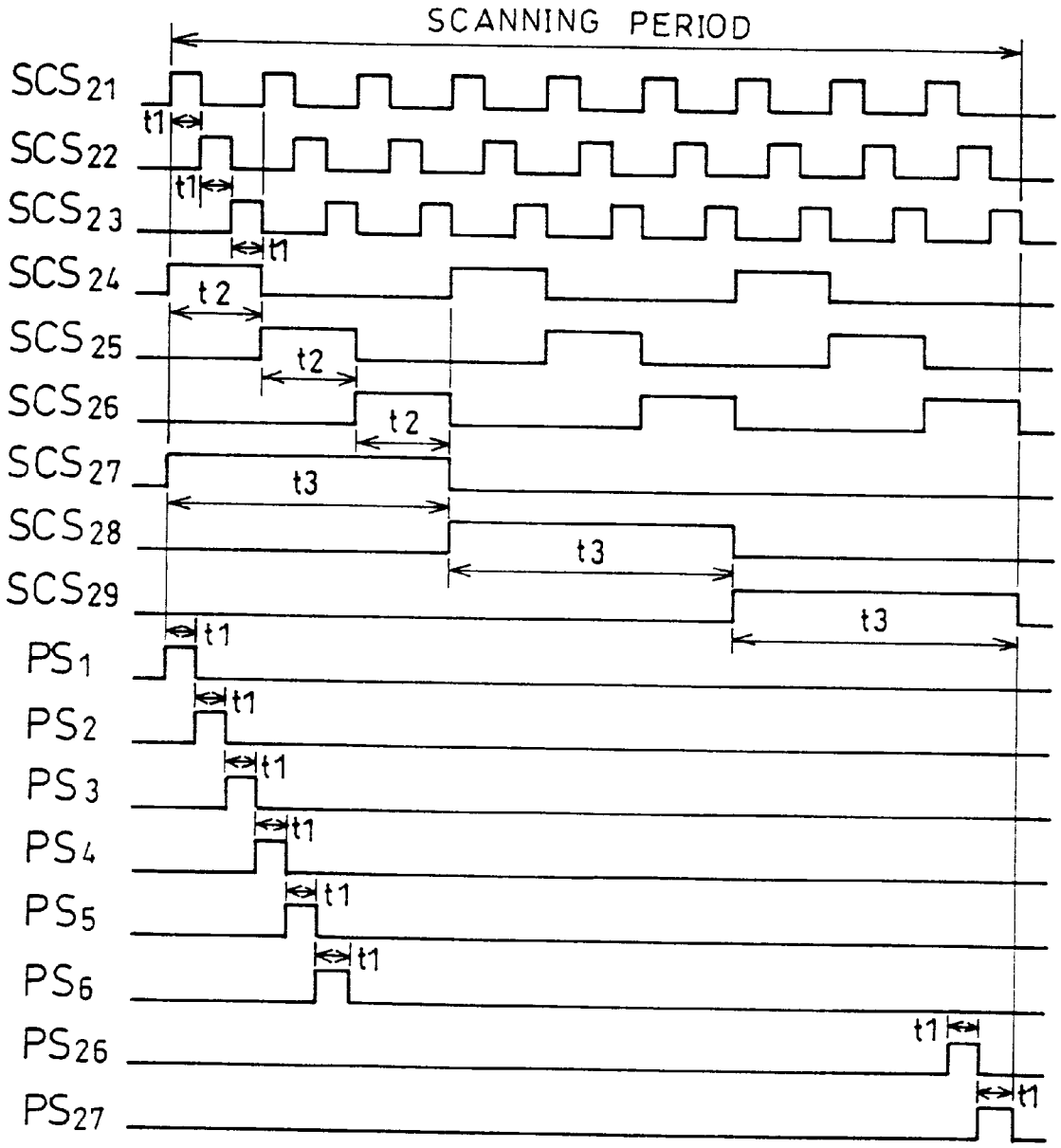
FIG. 7 is a timing chart illustrating scan control signals supplied to scan control signal lines and pulse signals outputted from pulse generating circuits in the scanning circuit.

The following de scription will discuss another embodiment of the present invention, while referring to FIGS. 6 and 7. The members having the same structure (function) as those in the above-mentioned first and second embodiments will be designated by the same reference numerals and their description will be omitted.

FIG. 6 is a circuit diagram illustrating a schematic arrangement of a scanning circuit of the present embodiment. Note that the figure is simplified for purposes of illustration, with a smaller number of signal lines, circuits, or the like. Therefore, there is no specific limitation on the number of the signal lines, circuits, or the like, which will be described below, and in a scanning circuit as a whole, actual numbers thereof may exceed the numbers described below.

The scanning circuit has nine SCS lines 18 ($18_1$ through $18_9$), and twenty-seven pulse generating circuits 20 ($20_1$ through $20_{27}$). The SCS lines th are divided into three SCS line groups $19_1$ and $19_3$.

FIG. 7 is a timing chart illustrating signal waveforms applied to respective parts of the scanning circuit. During a scanning period, scan control signals $SCS_{21}$ through $SCS_{23}$ are inputted to the signal lines $18_1$ through $18_3$ of the SCS line group $19_1$, respectively. Namely, inputted to the signal lines $18_1$ through $18_3$ are the signals arranged so that each has a pulse width of t1 and a cycle of t2 (=t1×3), and a rising timing difference between any signals supplied to neighboring SCS lines 18 is t1. Likewise, during the scanning period, scan control signals $SCS_{24}$ through $SCS_{26}$ are inputted to the signal lines $18_4$ through $18_6$ of the SCS line group $19_2$, respectively. Namely, inputted to the signal lines $18_4$ through $18_6$ are the signals arranged so that each has a pulse width of t2 (=t1×3) and a cycle of t3 (=t2×3=t1×9), and a rising timing difference between any signals supplied to neighboring SCS lines 18 is t2. The signals have rising and falling timings in synchronization with rising timings of one of the signals supplied to the SCS line group $19_1$. Furthermore, during the scanning period, scan control signals $SCS_7$ and $SCS_9$ are inputted to the signal lines $18_{27}$ and $18_{29}$ of the SCS line group $19_3$, respectively. Namely, inputted to the signal lines $18_{27}$ and $18_{29}$ are the signals arranged so that each has a pulse width of t3 (=t2×3=t1×9) and a cycle of t3×3 (=t2×9=t1×27), and a rising timing difference between any signals supplied to neighboring SCS lines 18 is t3. The signals have rising and falling timings in synchronization with rising timings of one of the signals supplied to the SCS line group $\mathbf{19}_2$. With this arrangement, at any time, three SCS lines 18 which are respectively from the SCS line groups $\mathbf{19}_1$ through $\mathbf{19}_3$ are supplied with signals at a "Hi" level. The combination of the three SCS lines changes per one reference time interval t1, and all the combinations during one scanning period differ from one another.

Thus, three SCS line 18 are respectively selected from the SCS line groups $\mathbf{19}_1$ through $\mathbf{19}_3$, so that the combinations are different, and the SCS lines in each combination are connected to each pulse generating circuit 20 through wires. In other words, supplied to each pulse generating circuit 20 are signals sent through three SCS lines 18 which are respectively selected from the SCS line groups $\mathbf{19}_1$ through $\mathbf{19}_3$. Then, at each pulse generating circuit 20, a logical computation is applied with respect to the inputted signals, and an AND signal of the inputted signals is outputted.

Thus, the different combinations of the SCS lines 18 for sending signals to the pulse generating circuits 20 are respectively connected to the pulse generating circuits 20, and the combinations respectively correspond to the combinations of SCS lines 18 receiving signals at a "Hi" level. Therefore, pulse signals are sequentially outputted from the pulse generating circuits 20, one pulse during each reference time interval t1. In other words, the combination of the scan control signals supplied to the pulse generating circuits $\mathbf{20}_1$ through $\mathbf{20}_{27}$ changes per reference time interval t1, and pulse signals $PS_1$ through $PS_{27}$ in accordance with the combinations of the scan control signals are outputted from the pulse generating circuits $\mathbf{20}_1$ through $\mathbf{20}_{27}$ to output lines $\mathbf{21}_1$ through $\mathbf{21}_{27}$, respectively.

Thus, the above-described scanning circuit has nine SCS lines 18, three input terminals of each pulse generating circuit 20, and twenty-seven pulse generating circuits 20, that is, twenty-seven outputs of the scanning circuit. In the case of a conventional scanning circuit having the same number of outputs, L which represents the number of necessary SCS lines is required to satisfy L=2×m and $2^{m-1}<27\leqq 2^m$. Since $2^4<27\leqq 2^5$, it is found that m=5. Therefore, it is found that in the scanning circuit of the above conventional arrangement, ten SCS lines and five input terminals of each pulse generating circuit are provided. Thus, the respective numbers of the SCS lines 18 and the input terminals of the pulse generating circuits 20 are reduced in the scanning circuit of the present embodiment, in comparison with the conventional arrangement.

On the other hand, the number of crossings which one SCS line 18 has with respect to the wires from the SCS lines 18 to the pulse generating circuits 20 is found as:

$$\left(L-1+i\times n(i)-\sum_{k=1}^{i} n(k)\right)\times\frac{x}{n(i)}=(8+i\times 3-i\times 3)\times\frac{27}{3}=8\times 9=72$$

On the other hand, regarding the conventional scanning circuit, the number of crossings which one SCS line has with respect to the wires from the SCS lines to the pulse generating circuits is found as:

$$(L-1)\times x/2=(10-1)\times 27/2=9\times 13.5=121.5$$

Therefore, the scanning circuit of the present embodiment has a smaller number of crossings of the SCS line 18 and the wires from the SCS lines 18 to the pulse generating circuits 20, in comparison with the conventional scanning circuit.

As has been so far described, in the case of the scanning circuit of the present embodiment, the respective numbers of (1) the SCS lines 18, (2) the input terminals of each pulse generating circuit 20, and (3) the crossings of the SCS lines 18 and the wires from the SCS lines 18 to the pulse generating circuits 20 are reduced, as compared with the conventional scanning circuit. Therefore, it is possible to reduce power consumption of the circuit and to scale down the circuit.

Furthermore, by applying the scanning circuit of the present embodiment to a matrix-type image display device of the arrangement earlier described or another arrangement, it is possible to reduce power consumption of the whole device, and to scale down the data signal line driving circuit 2 and the scanning signal line driving circuit 3.

Fourth Embodiment

Figure 8:
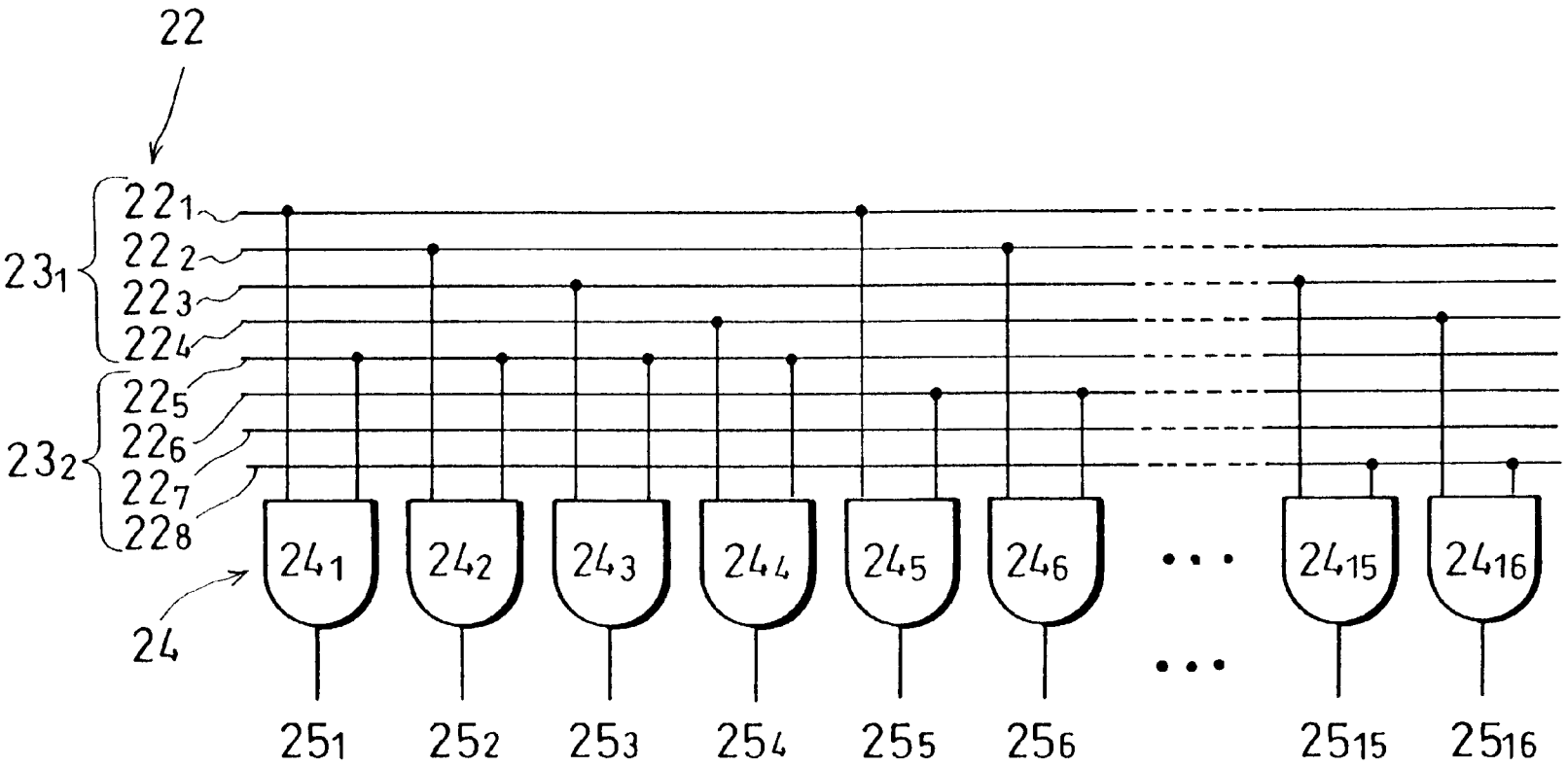
FIG. 8 is a circuit diagram illustrating a schematic arrangement of a scanning circuit of still another embodiment of the present invention.
Figure 9:
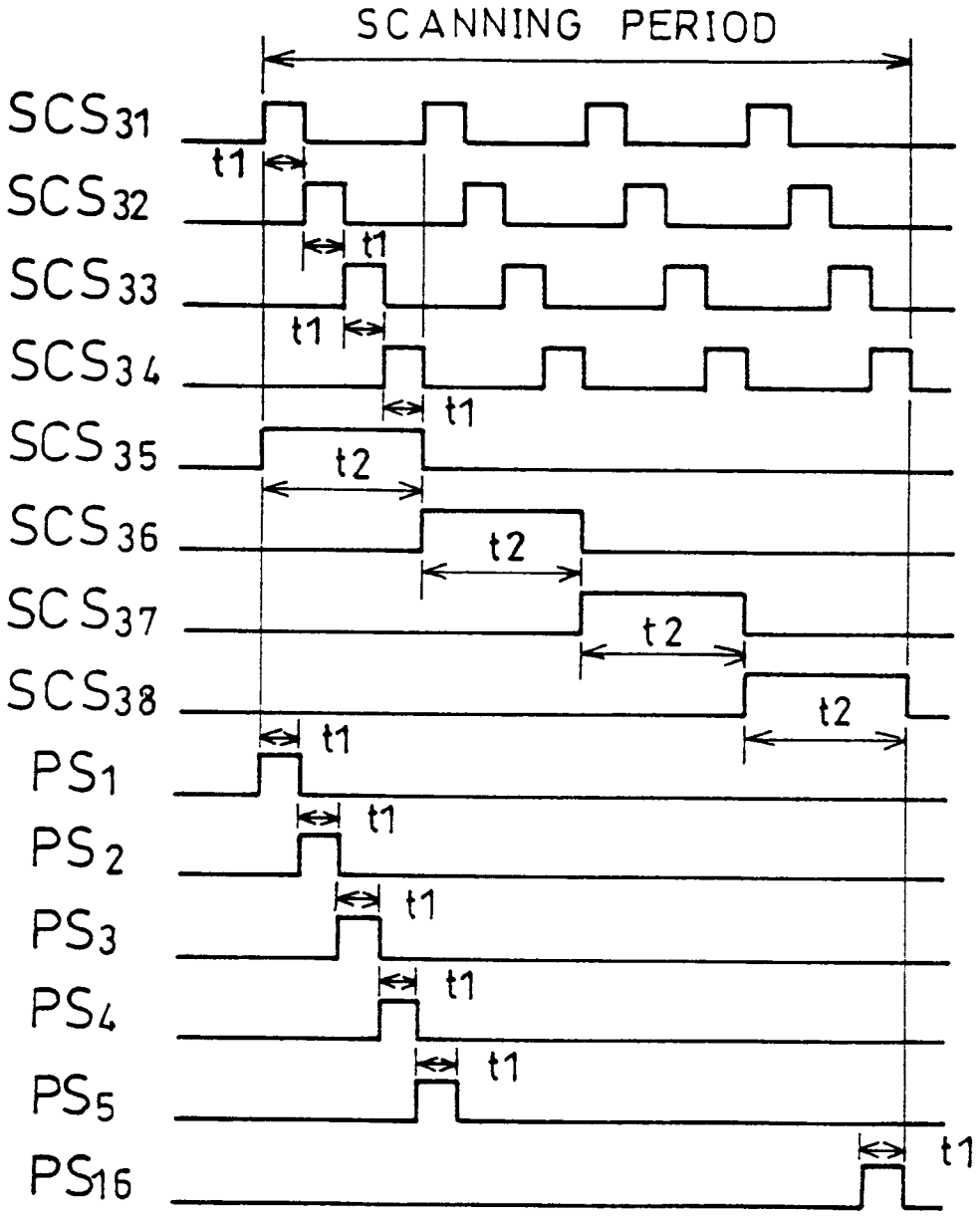
FIG. 9 is a timing chart illustrating scan control signals supplied to scan control signal lines and pulse signals outputted from pulse generating circuits in the scanning circuit.

The following description will discuss another embodiment of the present invention, while referring to FIGS. 8 and 9. The members having the same structure (function) as those in the above-mentioned first through third embodiments will be designated by the same reference numerals and their description will be omitted.

FIG. 8 is a circuit diagram illustrating a schematic arrangement of a scanning circuit of the present embodiment. Note that the figure is simplified for purposes of illustration, with a smaller number of signal lines, circuits, or the like. Therefore, there is no specific limitation on the number of the signal lines, circuits, or the like, which will be described below, and in a scanning circuit as a whole, actual numbers thereof may exceed the numbers described below.

The scanning circuit has eight SCS lines 22 ($\mathbf{22}_1$ through $\mathbf{22}_8$), and sixteen pulse generating circuits 24 ($\mathbf{24}_1$ through $\mathbf{24}_{16}$). The SCS lines 22 are divided into two SCS line groups $\mathbf{23}_1$ and $\mathbf{23}_2$.

FIG. 9 is a timing chart illustrating signal waveforms applied to respective parts of the scanning circuit. During a scanning period, scan control signals $SCS_{31}$ through $SCS_{34}$ are inputted to the signal lines $\mathbf{22}_1$ through $\mathbf{22}_4$ of the SCS line group $\mathbf{23}_1$, respectively. Namely, inputted to the signal lines $\mathbf{22}_1$ through $\mathbf{22}_4$ are the signals arranged so that each has a pulse width of t1 and a cycle of t2 (=t1×4), and a rising timing difference between signals supplied to neighboring SCS lines 22 is t1. Likewise, during the scanning period, scan control signals $SCS_{35}$ through $SCS_{38}$ are inputted to the signal lines $\mathbf{22}_5$ through $\mathbf{22}_8$ of the SCS line group $\mathbf{23}_2$, respectively. Namely, inputted to the signal lines $\mathbf{22}_5$ through $\mathbf{22}_8$ are the signals arranged so that each has a pulse width of t2 (=t1×4) and a cycle of t3 (=t2×4=t1×16), and a rising timing difference between any signals supplied to neighboring SCS lines 22 is t2. The signals have rising and falling timings in synchronization with rising timings of one of the signals supplied to the SCS line group $\mathbf{23}_1$. With this arrangement, at any time, two SCS lines 22 which are respectively selected from the SCS line groups $\mathbf{23}_1$ and $\mathbf{23}_2$ are supplied with signals at a "Hi" level. The combination of the two SCS lines changes per one reference time interval t1, and all the combinations during one scanning period differ from one another.

Thus, two SCS line 22 are respectively selected from the SCS line groups $\mathbf{23}_1$ and $\mathbf{23}_2$, so that the combinations are different, and the SCS lines in each combination are connected to each pulse generating circuit 24 through wires. In other words, supplied to each pulse generating circuit 24 are signals sent through two SCS lines 22 which are respectively selected from the SCS line groups $\mathbf{23}_1$ and $\mathbf{23}_2$. Then, at each pulse generating circuit 24, a logical computation is applied with respect to the inputted signals, and an AND signal of the inputted signals is outputted.

Thus, the different combinations of the SCS lines 22 for sending signals to the pulse generating circuits 24 are respectively connected to the pulse generating circuits 24, and the combinations respectively correspond to the combinations of SCS lines 22 receiving signals at a "Hi" level. Therefore, pulse signals are sequentially outputted from the pulse generating circuits 24, one pulse during each reference time interval t1. In other words, the combination of the scan control signals supplied to the pulse generating circuits $\mathbf{24}_1$ through $\mathbf{24}_{16}$ changes per reference time interval t1, and pulse signals $PS_1$ through $PS_{16}$ in accordance with the combinations of the scan control signals are outputted from the pulse generating circuits $\mathbf{24}_1$ through $\mathbf{24}_{16}$ to output lines $\mathbf{25}_1$ through $\mathbf{25}_{16}$, respectively.

Thus, the above-described scanning circuit has eight SCS lines 22, two input terminals of each pulse generating circuit 24, and sixteen pulse generating circuits 24, that is, sixteen outputs of the scanning circuit. In the case of a conventional scanning circuit having the same number of outputs, L which represents the number of necessary SCS lines is required to satisfy $L=2\times m$ and $2^{m-1}<16\leqq 2^m$. Since $2^3<16\leqq 2^4$, it is found that m=4. Therefore, it is found that in the scanning circuit of the above conventional arrangement, eight SCS lines and four input terminals of each pulse generating circuit are provided. Thus, the input terminals of the pulse generating circuits 24 are reduced in the scanning circuit of the present embodiment, in comparison with the conventional arrangement, though the number of the SCS lines 22 does not change.

On the other hand, the number of crossings which one SCS line 22 has with respect to the wires from the SCS lines 22 to the pulse generating circuits 24 is found as:

$$\left(L-1+i\times n(i)-\sum_{k=1}^{i} n(k)\right)\times\frac{x}{n(i)}=(7+i\times 4-i\times 4)\times\frac{16}{4}=7\times 4=28$$

On the other hand, regarding the conventional scanning circuit, the number of crossings which one SCS line has with respect to the wires from the SCS lines to the pulse generating circuits is found as:

$$(L-1)\times x/2=(8-1)\times 16/2=7\times 8=56$$

Therefore, the scanning circuit of the present embodiment has a smaller number of crossings of the SCS lines 22 and the wires from the SCS lines 22 to the pulse generating circuits 24, in comparison with the conventional scanning circuit.

As has been so far described, in the case of the scanning circuit of the present embodiment, the respective numbers of (1) the input terminals of each pulse generating circuit 24, and (2) the crossings of the SCS lines and the wires from the SCS lines 22 to the pulse generating circuits 24 are reduced, without increasing the number of the SCS lines 22, as compared with the conventional scanning circuit. Therefore, it is possible to reduce power consumption of the circuit and to scale down the circuit.

Furthermore, by applying the scanning circuit of the present embodiment to a matrix-type image display device of the arrangement earlier described or another arrangement, it is possible to reduce power consumption of the whole device, and to scale down the data signal line driving circuit 2 and the scanning signal line driving circuit 3.

Fifth Embodiment

Figure 10:
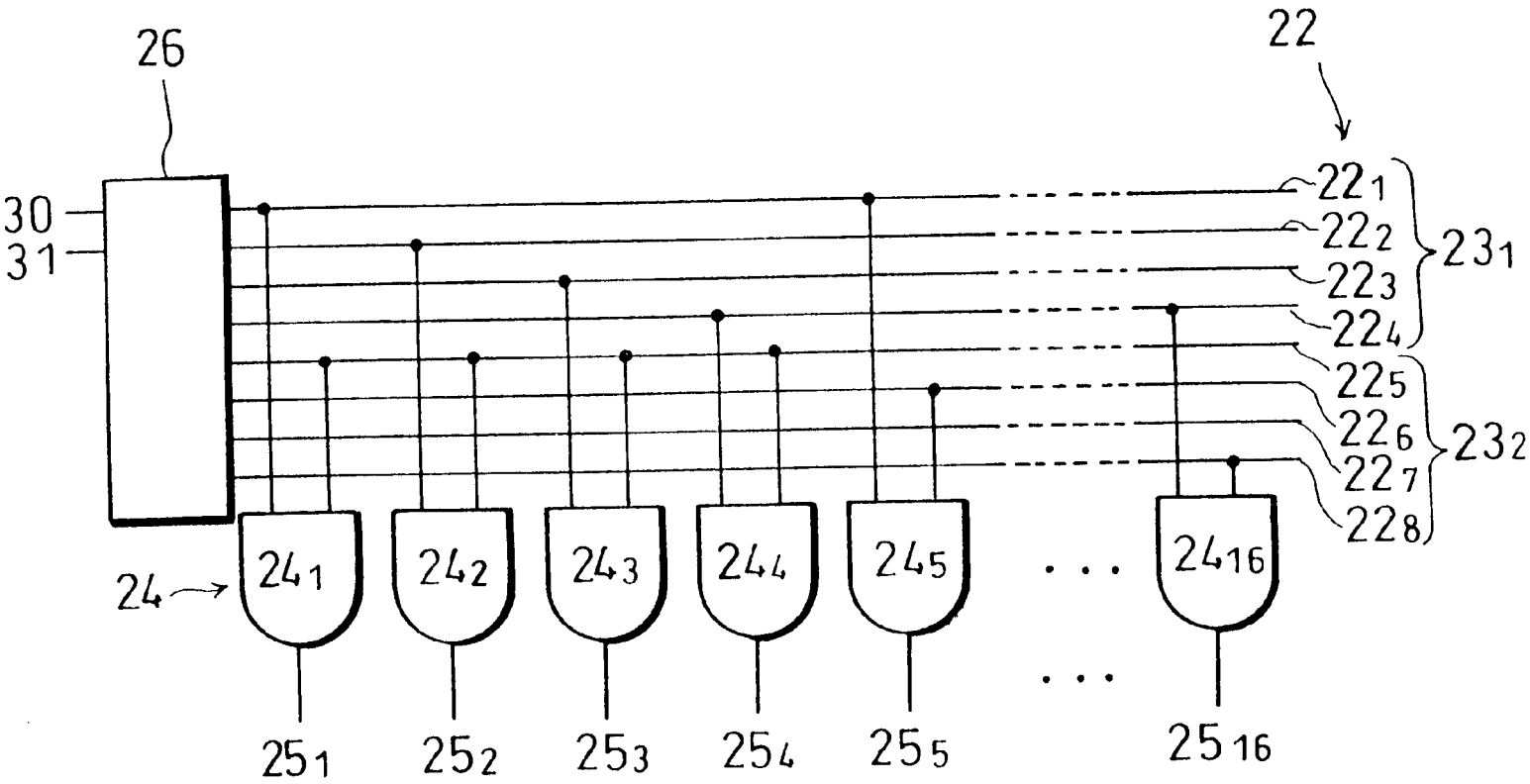
FIG. 10 is a circuit diagram illustrating a schematic arrangement of a scanning circuit of still another embodiment of the present invention.
Figure 11:
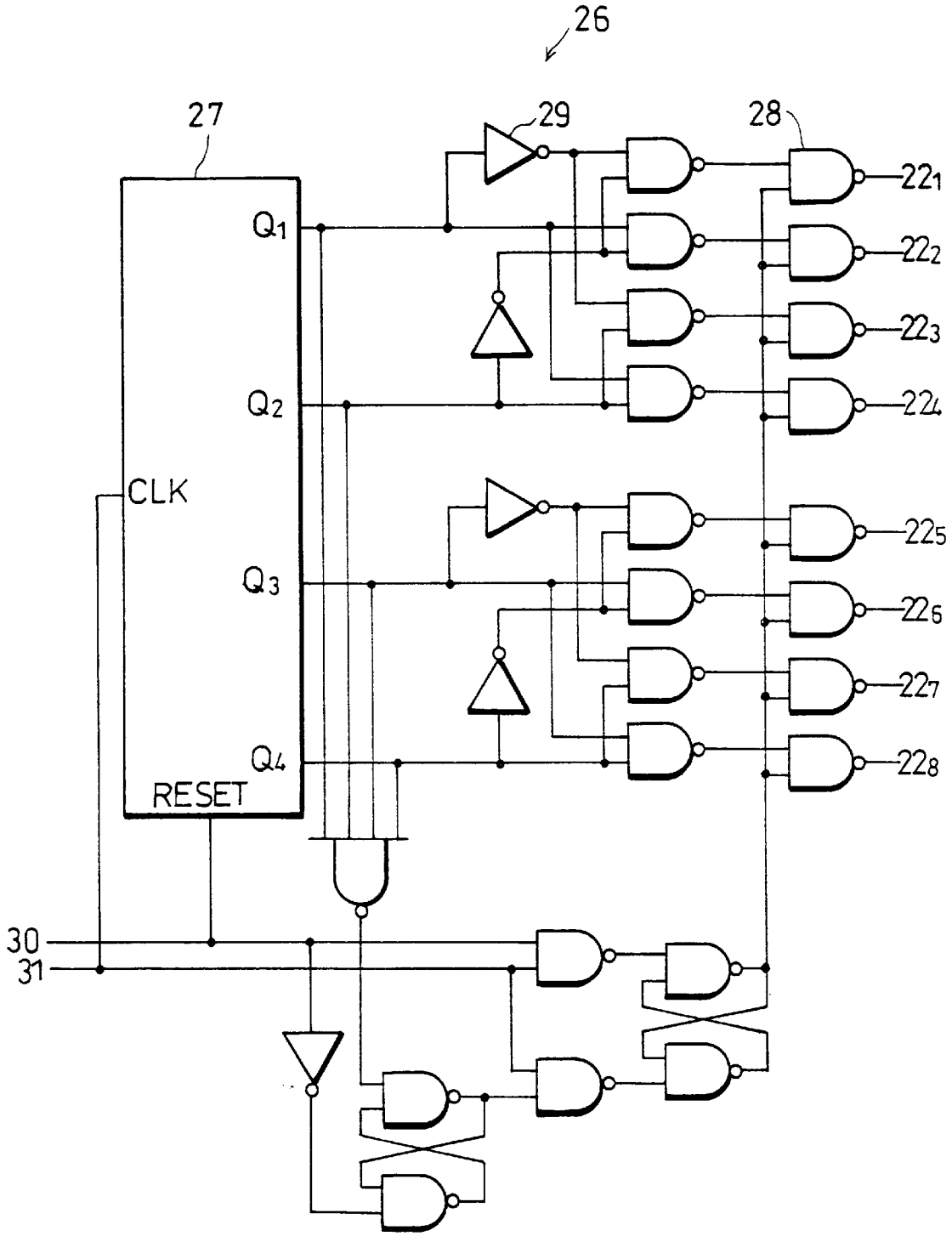
FIG. 11 is a circuit diagram illustrating a schematic arrangement of a scan control signal generating circuit provided in the scanning circuit.
Figure 12:
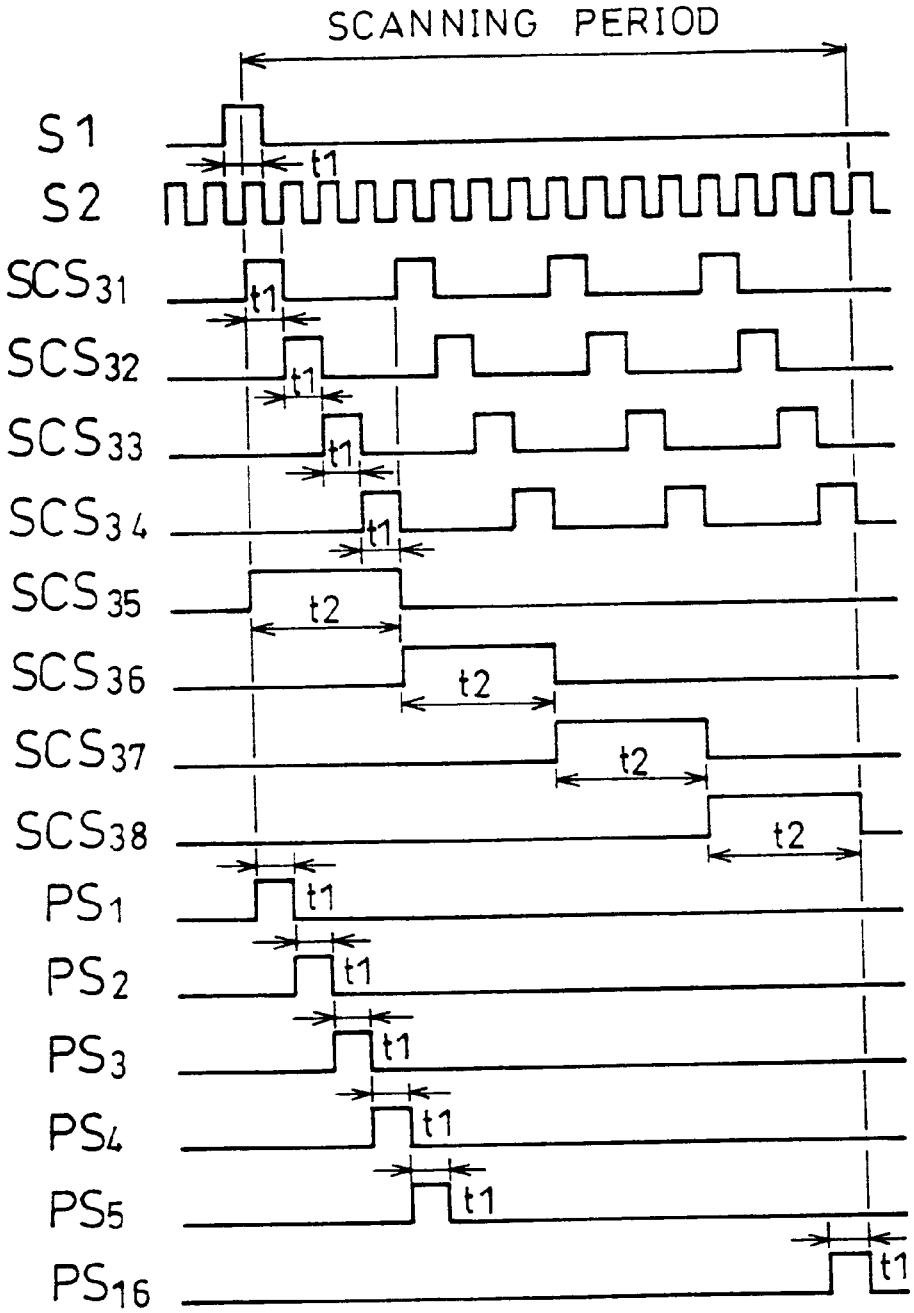
FIG. 12 is a timing chart illustrating scan control signals supplied to scan control signal lines and pulse signals outputted from pulse generating circuits in the scanning circuit.
Figure 13:
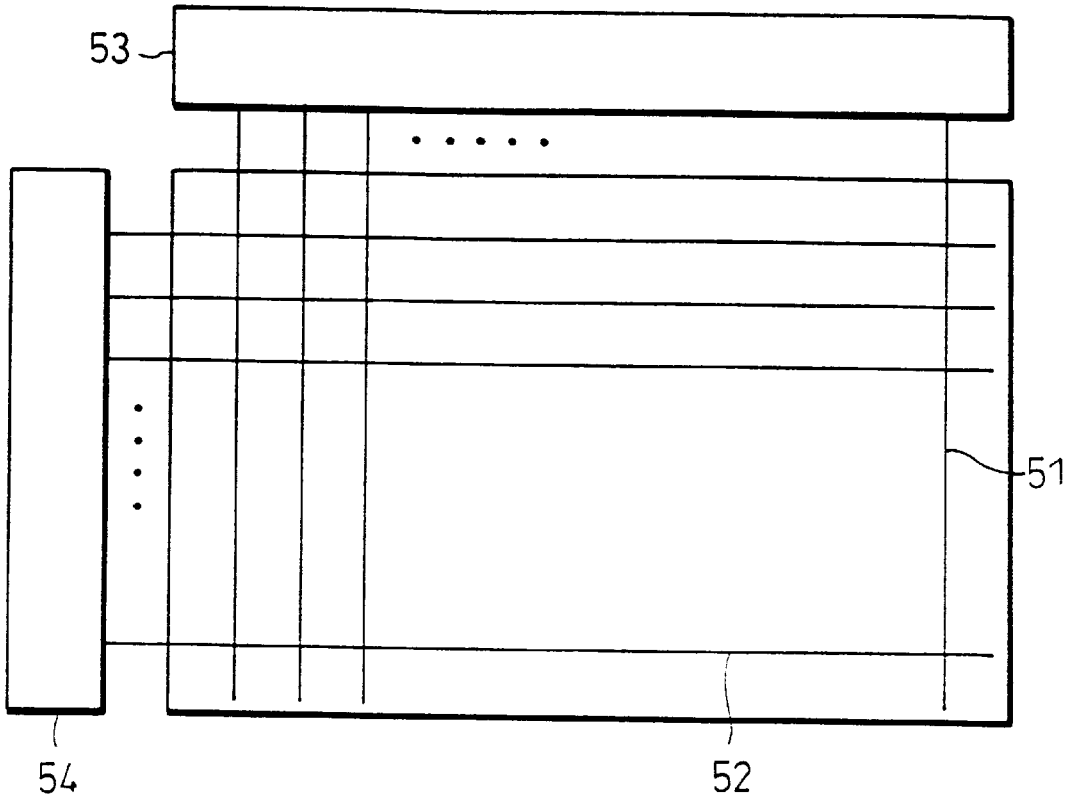
FIG. 13 PRIOR ART
FIG. 13 is a view illustrating a schematic arrangement of a conventional matrix-type image display device.
Figure 14:
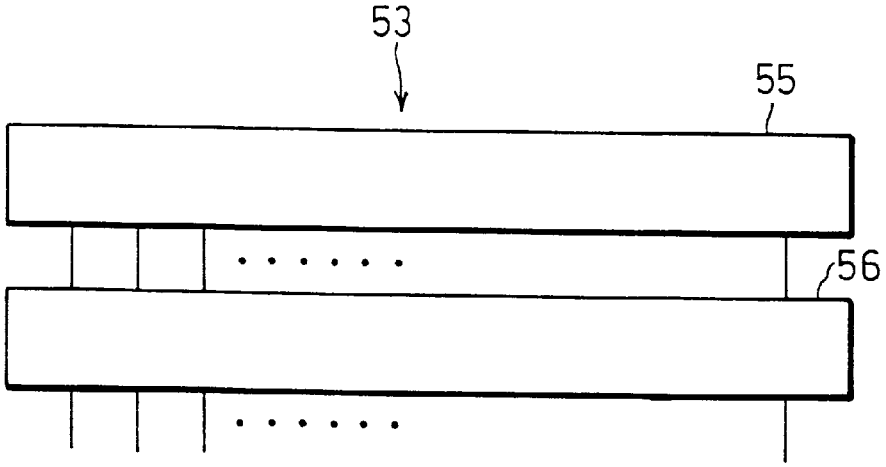
FIG. 14 PRIOR ART
FIG. 14 is a view illustrating a schematic arrangement of a data signal line driving circuit used in the conventional matrix-type image display device.
Figure 15:
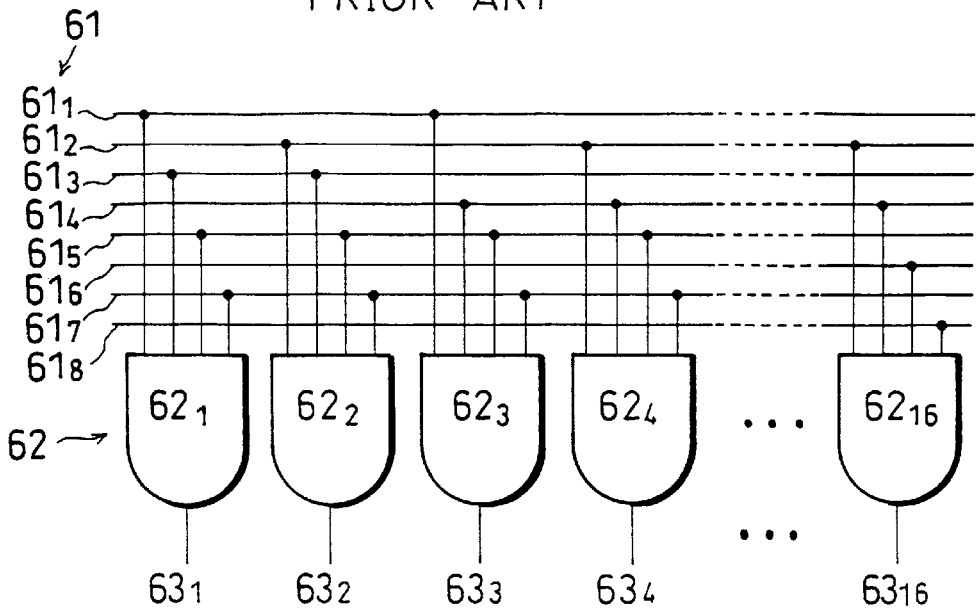
FIG. 15 PRIOR ART
FIG. 15 is a view schematically illustrating a conventional scanning circuit using a decoder.
Figure 16:
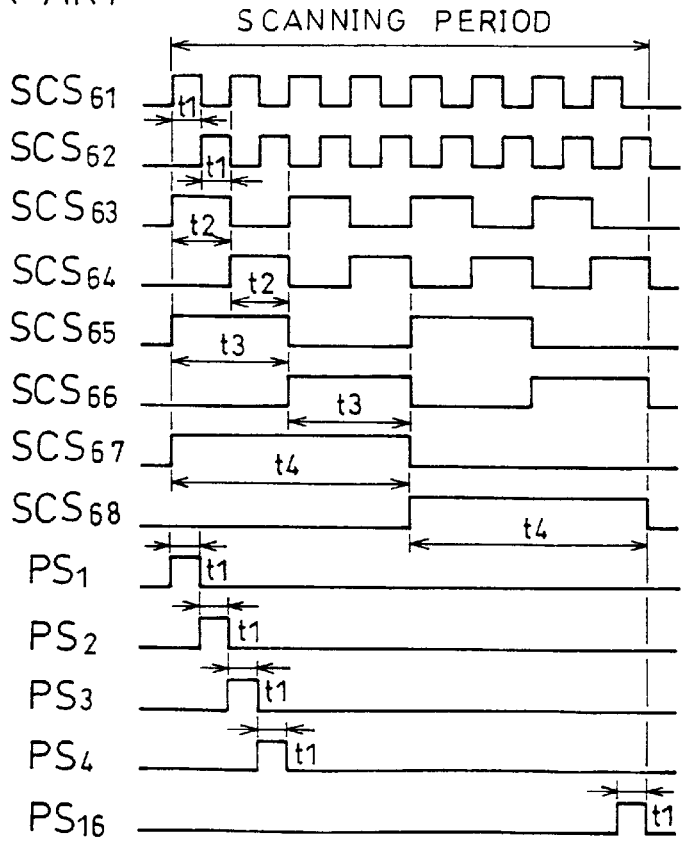
FIG. 16 PRIOR ART
FIG. 16 is a timing chart illustrating scan control signals supplied to the scan control signal lines and pulse signals outputted from pulse generating circuits in a conventional scanning circuit.

The following description will discuss still another embodiment of the present invention, while referring to FIGS. 10 through 12. The members having the same structure (function) as those in the above-mentioned first through fourth embodiments will be designated by the same reference numerals and their description will be omitted.

FIG. 10 is a circuit diagram illustrating a schematic arrangement of a scanning circuit of the present embodiment. Note that the figure is simplified for purposes of illustration, with a smaller number of signal lines, circuits, or the like. Therefore, there is no specific limitation on the number of the signal lines, circuits, or the like, which will be described below, and in a scanning circuit as a whole, actual numbers thereof may exceed the numbers described below.

The scanning circuit of the present embodiment, having the same arrangement as that of the fourth embodiment, further includes a scan control signal generating circuit (hereinafter referred to as SCS generating circuit) 26. Specifically, the scanning circuit has eight SCS lines 22 ($\mathbf{22}_1$ through $\mathbf{22}_8$), and sixteen pulse generating circuits 24 ($\mathbf{24}_1$ through $\mathbf{24}_{16}$), like in the fourth embodiment. The SCS lines 22 are divided into two SCS line groups $\mathbf{23}_1$ and $\mathbf{23}_2$.

As illustrated in FIG. 11, the SCS generating circuit 26 incorporates a counter 27 of four outputs (i.e., four bits), a plurality of NAND circuits 28, and a plurality of inverters 29. The SCS generating circuit 26 sends signals to the SCS lines $\mathbf{22}_1$ through $\mathbf{22}_8$, in response to a signal supplied through a scan start signal line 30 and a signal supplied through a timing control signal line 31.

As shown in FIG. 12, the signal supplied through the scan start signal line 30 is an operation control signal S1 for controlling the start/stop of the scanning operation, while the signal supplied through the timing control signal line 31 is a timing control clock S2 for controlling scanning timings. The SCS generating circuit 26 sends signals $SCS_{31}$ through $SCS_{38}$ to the SCS lines $\mathbf{22}_1$ through $\mathbf{22}_8$, respectively, in response to the input signals S1 and S2.

Note that the arrangement of the SCS generating circuit 26 is not necessarily the same as that shown in FIG. 11. Any arrangement can be adopted provided that scan control signals are generated therein and outputted in response to the operation control signal for controlling the start/stop of the scanning operation and the timing control clock for controlling scanning timings.

As is clear from FIGS. 10 and 12, during a scanning period, scan control signals $SCS_{31}$ through $SCS_{34}$ are inputted to the signal lines $\mathbf{22}_1$ through $\mathbf{22}_4$ of the SCS line group $\mathbf{23}_1$, respectively. The scan control signals $SCS_{31}$ through $SCS_{34}$ are arranged so that each has a pulse width of t1 and a cycle of t2 (=t1×4), and a rising timing difference between signals supplied to neighboring SCS lines 22 is t1. Likewise, during the scanning period, scan control signals $SCS_{35}$ through $SCS_{38}$ are inputted to the signal lines $\mathbf{22}_5$ through $\mathbf{22}_8$ of the SCS line group $\mathbf{23}_2$, respectively. The scan control signals $SCS_{35}$ through $SCS_{38}$ are arranged so that each has a pulse width of t2 (=t1×4) and a cycle of t3 (=t2×4=t1×16), and a rising timing difference between any signals supplied to neighboring SCS lines 22 is t2. The signals have rising and falling timings in synchronization with rising timings of one of the signals supplied to the SCS line group $\mathbf{23}_1$. Thus, the signals $SCS_{31}$ through $SCS_{38}$ supplied to the SCS lines $\mathbf{22}_1$ through $\mathbf{22}_8$ in the present embodiment are the same as those in the fourth embodiment.

Besides, as illustrated in FIG. 10, the scanning circuit of the present embodiment has the same arrangement as that of the fourth embodiment, except that the SCS generating circuit 26 is provided in the scanning circuit of the present embodiment. Therefore, in the case of the scanning circuit of the present embodiment, the respective numbers of the input terminals of each pulse generating circuit 24 and the crossings of the SCS lines and the wires from the SCS lines 22 to the pulse generating circuits 24 can be reduced without increasing the SCS lines 22, as compared with the conventional scanning circuit. Therefore, it is possible to reduce power consumption of the circuit and to scale down the circuit.

Furthermore, since the SCS generating circuit 26 is provided, it is possible to supply the signals $SCS_{31}$ through $SCS_{38}$ which are necessary for the operation of the scanning circuit to the respective SCS lines 22, only by supplying the signals S1 and S2 from outside to the scan start signal line 30 and the timing control signal line 31, respectively.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A scanning circuit, comprising:

a plurality of scan control signal lines to which scan control signals differing from one another are inputted; and a plurality of pulse generating circuits, each pulse generating circuit outputting a different pulse signal based on a logical computation on scan control signals respectively supplied from m scan control signal lines selected from among said scan control signal lines, combinations of the m scan control signal lines differing from one another, wherein:

said scan control signal lines are divided into m ($m \geqq 3$) scan control signal line groups each of which is supplied with signals of different pulse widths and cycle times, each of at least m−1 groups among the m scan control signal line groups being composed of three or four scan control signal lines; and one scan control signal line is selected in each scan control signal line group so as to constitute each combination of the m scan control signal lines for supplying the scan control signals to each pulse generating circuit.

2. The scanning circuit as set forth in claim 1, wherein:

in each scan control signal line group, signals supplied to said scan control signal lines belonging to the same have a same cycle and duty ratio; and given that an i'th ($i \leqq m$) scan control signal line group has n(i) scan control signal lines, each of scan control signals supplied to the scan control signal lines of the i'th scan control signal line group has, during a scanning period, a cycle n(i) times as great as that of a signal supplied to an (i−1)'th scan control signal line group during the scanning period.

3. The scanning circuit as set forth in claim 1, wherein at least m−1 scan control signal line groups have a same number of the scan control signal lines each.

4. The scanning circuit as set forth in claim 3, wherein at least m−1 scan control signal line groups have three scan control signal lines each.

5. The scanning circuit as set forth in claim 3, wherein at least m−1 scan control signal line groups have four scan control signal lines each.

6. The scanning circuit as set forth in claim 1, further comprising a scan control signal generating circuit for supplying signals to said scan control signal lines in response to an operation control signal for controlling the start/stop of the scanning operation and a timing control clock for controlling scanning timings.

7. A matrix-type image display device, comprising:

pixels for display, provided in matrix a;

a plurality of data signal lines for supplying image signals to said pixels;

a plurality of scanning signal lines being sequentially selected for sequential supply of data to said pixels, said scanning signal lines being provided orthogonal to said data signal lines;

a data signal line driving circuit for outputting image signals to said data signal lines; and a scanning signal line driving circuit for supplying scanning signals to said scanning signal lines, wherein at least either said data signal line driving circuit or said scanning signal line driving circuit has a scanning circuit, the scanning circuit including:

a plurality of scan control signal lines to which scan control signals differing from one another are inputted; and a plurality of pulse generating circuits, each pulse generating circuit outputting a different pulse signal based on a logical computation on scan control signals respectively supplied from m scan control signal lines selected from among the scan control signal lines, combinations of the m scan control signal lines differing from one another, wherein:

the scan control signal lines are divided into m ($m \geqq 3$) scan control signal line groups so that the scan control signal line groups respectively correspond to m groups of signals supplied to the scan control signal lines, each of at least m−1 groups among the m scan control signal line groups being composed of three or four lines; and one scan control signal line is selected in each scan control signal line group so as to constitute each combination of the m scan control signal lines for supplying the scan control signals to each pulse generating circuit.

8. The matrix-type display device as set forth in claim 7, wherein:

in each scan control signal line group, signals supplied to the scan control signal lines belonging to the same have a same cycle and duty ratio; and given that an i'th ($i \leqq m$) scan control signal line group has n(i) scan control signal lines, each of scan control signals supplied to the scan control signal lines of the i'th scan control signal line group has, during a scanning period, a cycle n(i) times as great as that of a signal supplied to an (i−1)'th scan control signal line group during the scanning period.

9. The matrix-type image display device as set forth in claim 7, wherein at least m−1 scan control signal line groups have a same number of the scan control signal lines each.

10. The matrix-type image display device as set forth in claim 9, wherein at least m−1 scan control signal line groups have three scan control signal lines each.

11. The matrix-type image display device as set forth in claim 9, wherein at least m−1 scan control signal line groups have four scan control signal lines each.

12. The matrix-type image display device as set forth in claim 7, wherein the scanning circuit further includes a scan control signal generating circuit for supplying signals to said scan control signal lines in response to an operation control signal for controlling the start/stop of the scanning operation and a timing control clock for controlling scanning timings.

13. A scanning circuit, comprising:

scan control signal lines organized into m (m≧3) scan control signal line groups each of which is supplied with signals of different pulse widths and cycle times; and pulse generating circuits each of which is connected to a different combination of said scan control signal lines, each combination including one scan control signal line from each scan control signal line group, wherein at least m−1 of the m scan control signal line groups consist of either three or four scan control signal lines.

14. The scanning circuit as set forth in claim 13, wherein the pulse widths of the signals supplied to the scan control signal lines of the ith one of the m scan control signal line groups are equal to the cycle times of the signals supplied to the scan control signal lines of the (i−1)th one of the m scan control signal line groups.

15. The scanning circuit as set forth in claim 13, wherein at least m−1 of the m scan control signal line groups each consist of three scan control signal lines.

16. The scanning circuit as set forth in claim 13, wherein at least m−1 of the m scan control signal line groups each consist of four scan control signal lines.

17. The scanning circuit as set forth in claim 13, wherein groups and signal lines are organized into m scan control signal line groups and at least m−1 of the m scan control signal line groups have the same number of scan control signal lines.

18. The scanning circuit as set forth in claim 13, wherein the remaining scan control signal line group has 2 to 6 scan control signal lines.

19. The scanning circuit as set forth in claim 13, wherein said pulse generating circuits each comprises a logic circuit for logically combining the signals on the scan control signal lines connected thereto.

20. The scanning circuit as set forth in claim 13, further comprising:

a signal generating circuit for generating the signals supplied to said scan control signal line groups in response to an operation control signal for controlling the start/stop of a scanning operation and a timing control clock for controlling scanning timings.

21. A liquid crystal display device comprising:

a matrix of pixels connected to data signal lines extending in a first direction and scanning signal lines extending in a second direction;

a data signal line driving circuit for driving said data signal lines; and a scanning signal line driving circuit for driving said scanning signal lines, wherein at least one of said data signal line driving circuit and said scanning signal line driving circuit comprises a scanning circuit as set forth in claim 13.

* * * * *